US012735164B1

(12) United States Patent
Krupp et al.

(10) Patent No.: US 12,735,164 B1
(45) Date of Patent: Sep. 15, 2026

(54) MARINE DRIVES

(71) Applicant: Brunswick Corporation, Mettawa, IL (US)

(72) Inventors: Timothy D. Krupp, Fond du Lac, WI (US); Timothy J. Eddy, Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 480 days.

(21) Appl. No.: 18/219,438

(22) Filed: Jul. 7, 2023

(51) Int. Cl.

| | |
|---|---|
| ***B63H 21/30*** | (2006.01) |
| ***B63H 20/02*** | (2006.01) |
| ***B63H 20/32*** | (2006.01) |
| *B63H 20/00* | (2006.01) |

(52) U.S. Cl.
CPC ..... *B63H 21/305* (2013.01); *B63H 20/32* (2013.01); *B63H 2020/008* (2013.01); *B63H 2020/025* (2013.01)

(58) Field of Classification Search
CPC ..... B63H 21/305; B63H 20/32; B63H 2020/008; B63H 2020/025
See application file for complete search history.

(56) References Cited

U.S. PATENT DOCUMENTS 3,210,494 A 10/1965 Murdock
3,358,668 A * 12/1967 Post ..... B63H 21/305 123/198 E
3,593,050 A 7/1971 Ware
3,853,730 A 12/1974 Anderson
3,953,742 A 4/1976 Anderson et al.
3,954,082 A 5/1976 Roller
3,995,513 A 12/1976 Amdall
4,322,633 A 3/1982 Staerzl
4,492,877 A 1/1985 Staerzl
4,528,460 A 7/1985 Staerzl
4,583,953 A * 4/1986 Nakase ..... B63H 20/32 440/89 C (Continued)

FOREIGN PATENT DOCUMENTS

CA 1040134 10/1978
CA 1056766 6/1979

(Continued)

OTHER PUBLICATIONS

Sawyer et al., Unpublished U.S. Appl. No. 17/469,479, filed Sep. 8, 2021.

(Continued)

*Primary Examiner* — Andrew Polay
(74) *Attorney, Agent, or Firm* — Andrus Intellectual Property Law, LLP

(57) ABSTRACT

A marine drive is for propelling a marine vessel in water. The marine drive comprises an upper unit; a lower unit for supporting a propulsor for propelling the marine drive in the water, wherein the lower unit is suspended from the upper unit and is configured for attachment to the marine vessel via a mounting bracket which supports the marine drive relative to the marine vessel; a cowling suspended on the upper unit apart from the lower unit; and a vibration isolating joint which couples the lower unit to the upper unit so as to vibrationally isolate the upper unit and the cowling from the lower unit and the marine vessel.

19 Claims, 22 Drawing Sheets

(56) References Cited

U.S. PATENT DOCUMENTS

| | | | |
|---|---|---|---|
| 4,632,487 | A | 12/1986 | Wargula |
| 4,787,868 | A | 11/1988 | Hoshiba |
| 4,897,059 | A | 1/1990 | Newman |
| 4,969,847 | A | 11/1990 | Curtis |
| 5,188,548 | A | 2/1993 | Ferguson et al. |
| 5,192,235 | A | 3/1993 | Dunham et al. |
| 5,219,306 | A | 6/1993 | Takahashi |
| 5,511,997 | A | 4/1996 | Yoshida |
| 5,747,892 | A | 5/1998 | Staerzl |
| 5,840,164 | A | 11/1998 | Staerzl |
| 5,931,513 | A | 8/1999 | Conti |
| 6,183,625 | B1 | 2/2001 | Staerzl |
| 6,209,472 | B1 | 4/2001 | Staerzl |
| 6,547,952 | B1 | 4/2003 | Staerzl |
| 6,559,660 | B1 | 5/2003 | Staerzl |
| 6,822,462 | B1 | 11/2004 | Staerzl |
| 6,913,498 | B1 | 7/2005 | Sheth |
| 7,064,459 | B1 | 6/2006 | Staerzl |
| 7,131,877 | B1 | 11/2006 | Staerzl |
| 7,305,928 | B2 | 12/2007 | Bradley et al. |
| 7,381,312 | B1 | 6/2008 | Misorski et al. |
| 7,387,553 | B1 | 6/2008 | Misorski et al. |
| 7,896,304 | B1 | 3/2011 | Eichinger et al. |
| 8,118,983 | B1 | 2/2012 | Anderson et al. |
| 8,231,994 | B2 | 7/2012 | Zhou |
| 8,372,260 | B1 | 2/2013 | Staerzl et al. |
| 8,891,237 | B2 | 11/2014 | Shinoda |
| 9,168,979 | B1 | 10/2015 | Schueller et al. |
| 9,180,950 | B1 | 11/2015 | Davenport |
| 9,341,008 | B1 | 5/2016 | Amerling |
| 9,446,828 | B1 | 9/2016 | Groeschel et al. |
| 9,580,947 | B1 | 2/2017 | Amerling |
| 9,589,457 | B1 | 3/2017 | Wengreen |
| 9,701,383 | B1 | 7/2017 | Stuber et al. |
| 9,764,813 | B1 | 9/2017 | Zarembka et al. |
| 9,963,213 | B1 | 5/2018 | Jaszewski et al. |
| 10,202,180 | B1 | 2/2019 | Amerling et al. |
| 10,246,173 | B1 | 4/2019 | Ingebritson |
| 10,696,367 | B1 | 6/2020 | Ingebritson et al. |
| 10,787,236 | B1 | 9/2020 | Erickson et al. |
| 10,981,637 | B1 | 4/2021 | Alby et al. |
| 11,046,409 | B2 | 6/2021 | Wiegele |
| 11,097,826 | B1 | 8/2021 | Dannenberg et al. |
| 11,180,235 | B2 | 11/2021 | Wiatrowski |
| 11,186,352 | B1 | 11/2021 | Erickson et al. |
| 11,214,346 | B1 | 1/2022 | Jaeger et al. |
| 11,572,145 | B1 | 2/2023 | Andrasko |
| 11,866,137 | B1 | 1/2024 | Jaszewski |
| 2010/0055999 | A1* | 3/2010 | Wright ..... B63H 21/305 440/52 |
| 2017/0129577 | A1 | 5/2017 | Mizutani |
| 2019/0061512 | A1 | 2/2019 | Noguez |

FOREIGN PATENT DOCUMENTS

| | | | |
|---|---|---|---|
| EP | 0479576 | A2 | 4/1992 |
| GB | 2133592 | | 8/1986 |
| WO | 2009055663 | A1 | 4/2009 |

OTHER PUBLICATIONS

Fergus et al., Unpublished U.S. Appl. No. 17/487,116, filed Sep. 28, 2021.

Schrank et al., Unpublished U.S. Appl. No. 17/509,739, filed Oct. 25, 2021.

Jaszewski, et al., Unpublished U.S. Appl. No. 17/550,463, filed Dec. 14, 2021.

Dannenberg, et al., Unpublished U.S. Appl. No. 17/554,540, filed Dec. 17, 2021.

Jaszewski, et al., Unpublished U.S. Appl. No. 17/585,214, filed Jan. 26, 2022.

Waldvogel, et al., Unpublished U.S. Appl. No. 17/671,041, filed Feb. 14, 2022.

Declaration of Prior Art signed by inventor Benjamin C. Wald on Sep. 2, 2022.

Office Action issued in U.S. Appl. No. 18/219,459, dated Oct. 9, 2025.

* cited by examiner

MARINE DRIVES

FIELD

The present disclosure relates to marine drives for propelling a marine vessel in water.

BACKGROUND

The following U.S. Patents provides background and are incorporated herein by reference:

U.S. Pat. No. 10,202,180 discloses an outboard motor including an engine coupled in torque-transmitting relationship with a propulsor via a driveshaft.

U.S. Pat. No. 11,214,346 discloses a marine drive including a propulsion unit, a supporting cradle that couples the propulsion unit to a transom bracket for attachment to a marine vessel, and a cowling system that at least partially covers a portion of the propulsion unit and a portion of the supporting cradle.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In non-limiting examples disclosed herein, a marine drive is for propelling a marine vessel in water. The marine drive comprises an upper unit, a lower unit for supporting a propulsor for propelling the marine drive in the water, wherein the lower unit is suspended from the upper unit and is configured for attachment to the marine vessel via a mounting bracket which supports the marine drive relative to the marine vessel, a cowling suspended on the upper unit apart from the lower unit, and a vibration isolating joint which couples the lower unit to the upper unit so as to vibrationally isolate the upper unit and the cowling from the lower unit and the marine vessel.

Optionally, vibrations emanating from the propulsor may be transferred via the lower unit to the vibration isolating joint, thereby vibrationally isolating the upper unit and the cowling from the propulsor. Optionally, the marine drive may comprise an electric motor on the lower unit. The electric motor may be configured to power the propulsor, and vibrations from the electric motor may be transferred via the lower unit to the vibration isolating joint, thereby vibrationally isolating the upper unit and the cowling from the electric motor. Optionally, the lower unit may comprise a torpedo housing, wherein the electric motor is supported in the torpedo housing. Optionally, the upper unit may comprise a supporting frame and the lower unit may comprise an extension leg which extends from and is suspended on the supporting frame via the vibration isolating joint. Optionally, the supporting frame may comprise a lower mounting flange, the extension leg may comprise an upper mounting flange which faces the lower mounting flange, and the vibration isolating joint may couple the lower mounting flange to the upper mounting flange.

Optionally, the vibration isolating joint may comprise an elastomeric member which is clamped between the lower mounting flange and the upper mounting flange and configured to limit transfer of vibrations from the extension leg to the supporting frame. Optionally the vibration isolating joint may comprise a compression limiter which prevents over clamping of the elastomeric member during assembly of the lower unit and the upper unit. Optionally, the vibration isolating joint may comprise a fastener, and tightening the fastener may clamp the elastomeric member between the extension leg and the supporting frame, wherein the compression limiter prevents over tightening of the fastener to thereby prevent over compression of the elastomeric member. Optionally, tightening the fastener may clamp the elastomeric member between the lower mounting flange and the upper mounting flange. Optionally, the compression limiter may comprise a first limiter portion located between the extension leg and the supporting frame and a second limiter portion located on an opposite side of one of the extension leg and the supporting frame relative to the first limiter portion, and the elastomeric member may comprise a first resilient portion located between the first limiter portion and the one of the extension leg and the supporting frame and a second resilient portion located between the second limiter portion and the one of the extension leg and the supporting frame.

Optionally, the cowling may have a first cowl portion and a second cowl portion which together define a cowl interior in which the upper unit is disposed. Optionally, each of the first cowl portion and the second cowl portion may be coupled to the upper unit, and further wherein the first cowl portion and the second cowl portion may be coupled to each other, apart from the upper unit. Optionally, the first cowl portion may be a port side cowl portion and wherein the second cowl portion may be a starboard side cowl portion, and wherein the port side cowl portion and the starboard side cowl portion are fastened to opposite sides of the upper unit and to each other.

Optionally, the upper unit may comprise a frame body and a service tray and wherein the cowling is suspended from the service tray. Optionally, the marine drive may comprise a service lid on the service tray.

In non-limiting examples disclosed herein, a marine drive is for propelling a marine vessel in water. The marine drive extends from a top to a bottom along a first axis, from a port side to a starboard side along a second axis which is perpendicular to the first axis, and from a front to a back along a third axis which is perpendicular to the first axis and perpendicular to the second axis. The marine drive comprises an upper unit and a lower unit disposed below the upper unit along the first axis, wherein the lower unit is configured to support a propulsor for propelling the marine drive in the water, and wherein the lower unit is suspended from the upper unit and is configured for attachment to the marine vessel via a mounting bracket which supports the marine drive relative to the marine vessel. A cowling is suspended on the upper unit and is fully separated from the lower unit. The cowling comprises an upper portion which is coupled to and encloses the upper unit and a lower portion which is spaced apart from but encloses an upper portion of the lower unit. A vibration isolating joint couples the lower unit to the upper unit so as to vibrationally isolate the upper unit and the cowling from the lower unit and the marine vessel.

Optionally, vibrations emanating from the propulsor may be transferred to the marine vessel via the lower unit and to the vibration isolating joint, thereby vibrationally isolating the upper unit and the cowling from the propulsor and the marine vessel. Optionally, the cowling further comprises a first cowl portion and a second cowl portion which may both be coupled to the upper unit, and further wherein the first cowl portion and the second cowl portion may be coupled to each other at a location spaced apart from the upper unit.

Optionally, the cowling further may comprise a port side cowl portion and a starboard side cowl portion, and wherein the port side cowl portion and the starboard side cowl portion may be fastened to the port side and the starboard side of the upper unit, respectively, and also fastened to each other.

In non-limiting examples disclosed herein, a marine drive is for propelling a marine vessel in water. The marine drive comprises a supporting frame and a cowling on the supporting frame. The cowling comprises a cowl body and a service lid which encloses a service compartment within the cowl body. The service lid is movable into and between a service position in which the service lid is removed from the cowl body and the service compartment, an unregistered position in which the service lid at least partially covers the service compartment, and a registered position in which the service lid is locked relative to the cowl body and encloses the service compartment.

Optionally, the service lid may be slidable into and between the unregistered position and the registered position. Optionally, the service lid may be slidable along at least one of the supporting frame and the cowl body. Optionally, in the service position, the service lid may be completely separated from the cowl body. Optionally the marine drive may include a lifting eye for lifting the marine drive, and the lifting eye may be accessible in the service compartment when the service lid is in the service position. Optionally, the marine drive may comprise a fuse which is accessible in the service compartment when the service lid is in the service position. Optionally, the marine drive may comprise a spare engine lanyard clip coupled to the service lid.

Optionally, the service lid is slidable along the supporting frame into and between the unregistered position and the registered position. Optionally, the supporting frame may comprise a frame body and a service tray coupled to the frame body, and the service lid may be slidable along the service tray. Optionally, the marine drive may comprise an engagement device which facilitates engagement, sliding and registration of the service lid relative to the supporting frame. Optionally, the engagement device may comprise a probe and a recess which are configured such that sliding of the service lid from the unregistered position to the registered position engages the probe in the recess, which aligns the service lid relative to the cowl body in the registered position.

Optionally, the marine drive may comprise a toolless locking device which is operable to lock and unlock the service lid in the registered position. Optionally, the toolless locking device may comprise a spring-loaded turnkey. Optionally, the engagement device may comprise a probe and a recess which are configured such that sliding of the service lid from the unregistered position to the registered position engages the probe in the recess, which aligns the service lid relative to the cowl body in the registered position and facilitates locking of the service lid via the toolless locking device.

In non-limiting examples disclosed herein, a marine drive is for propelling a marine vessel in water. The marine drive extends from a top to a bottom along a first axis, from a port side to a starboard side along a second axis which is perpendicular to the first axis, and from a front to a back along a third axis which is perpendicular to the first axis and perpendicular to the second axis. The marine drive comprises a supporting frame and a cowling on the supporting frame. The cowling comprises a cowl body and a service lid which encloses a service compartment located on the top of the marine drive. The service lid is movable into and between a service position in which the service lid is removed from the cowl body and the service compartment, an unregistered position in which the service lid is located on the top of the cowl body so as to at least partially cover the service compartment, and a registered position in which the service lid is locked relative to the cowl body and encloses the service compartment.

Optionally, the service lid may be slidable into and between the unregistered position and the registered position. Optionally, the service lid may be slidable along at least one of the supporting frame and the cowl body. Optionally, in the service position, the service lid may be completely separated from the cowl body. Optionally, the marine drive may comprise an engagement device which facilitates engagement, sliding and registration of the service lid relative to the supporting frame. Optionally, the engagement device may comprise a probe and a recess which are configured such that sliding of the service lid from the unregistered position to the registered position engages the probe in the recess, which aligns the service lid relative to the cowl body in the registered position. Optionally, the marine drive may comprise a toolless locking device which is operable to lock and unlock the service lid in the registered position.

Optionally, the probe may comprise a plurality of prongs configured to be received in the recess. Optionally, the engagement between the plurality of prongs and the recess creates a friction fit for retaining the probe in the recess and preventing vibration of the service lid. Optionally, the probe may comprise a pin received in a pin bracket formed on one of the service lid and the supporting frame, and wherein the recess is formed in a recess bracket on the other one of the service lid and the supporting frame. Optionally, a first end of the pin is received in the pin bracket and a second end of the pin is slidably received in the recess bracket. Optionally, sliding abutment between the pin and a locating surface of the recess bracket facilitates the sliding of the service lid between the unregistered position and the registered position. Optionally, an elastomeric O-ring is installed on the pin creating a friction fit between the pin and pin bracket to retain the pin in the pin bracket and preventing vibration of the service lid.

Various other features, objects, and advantages will be made apparent from the following description taken together with the drawings.

BRIEF DESCRIPTION OF THE DRAWINGS

The present disclosure is described with reference to the following drawings.

DETAILED DISCLOSURE

Figure 1:
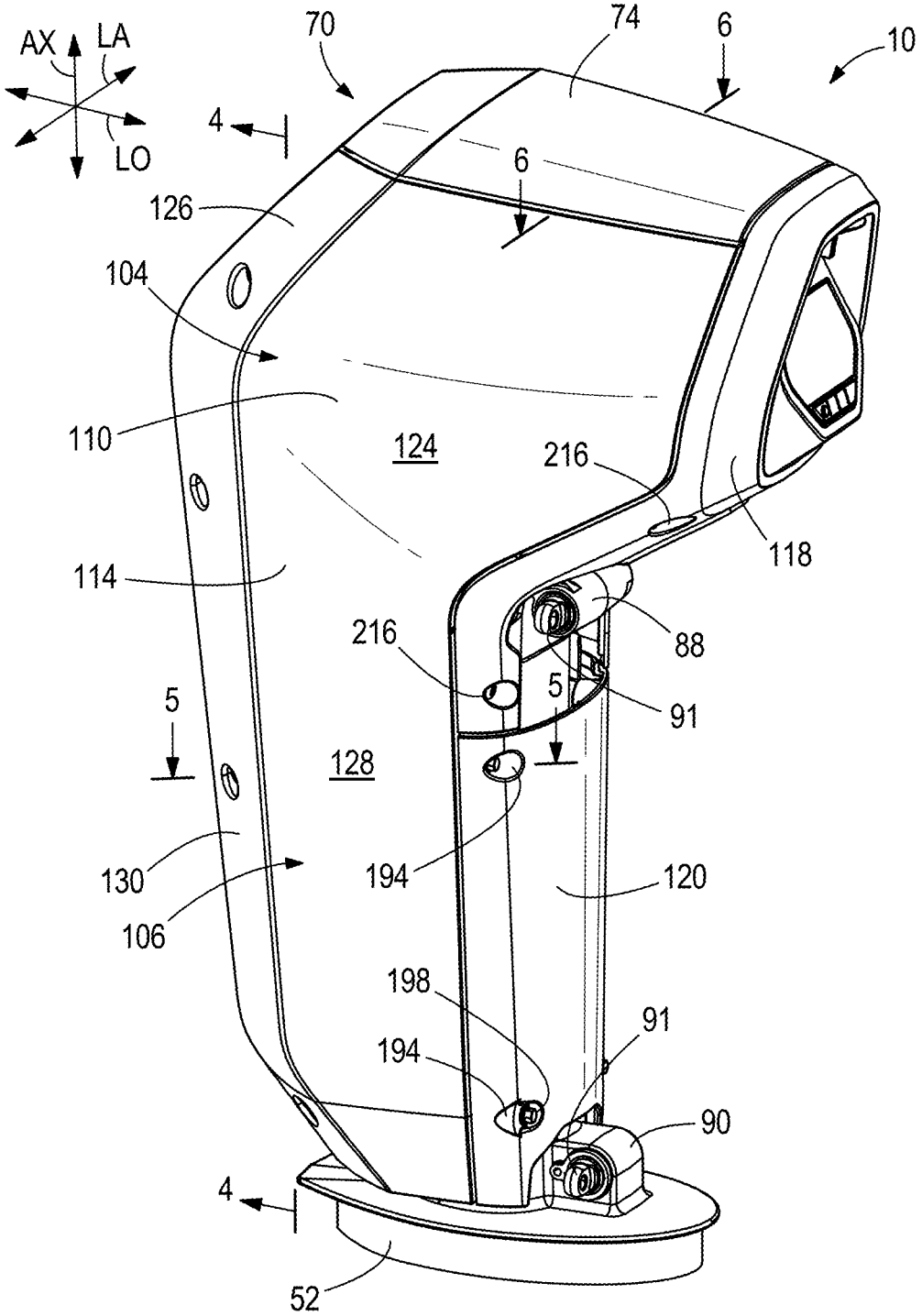
FIG. 1 is a perspective view of a marine drive for propelling a marine vessel in water according to the present disclosure.
Figure 10:
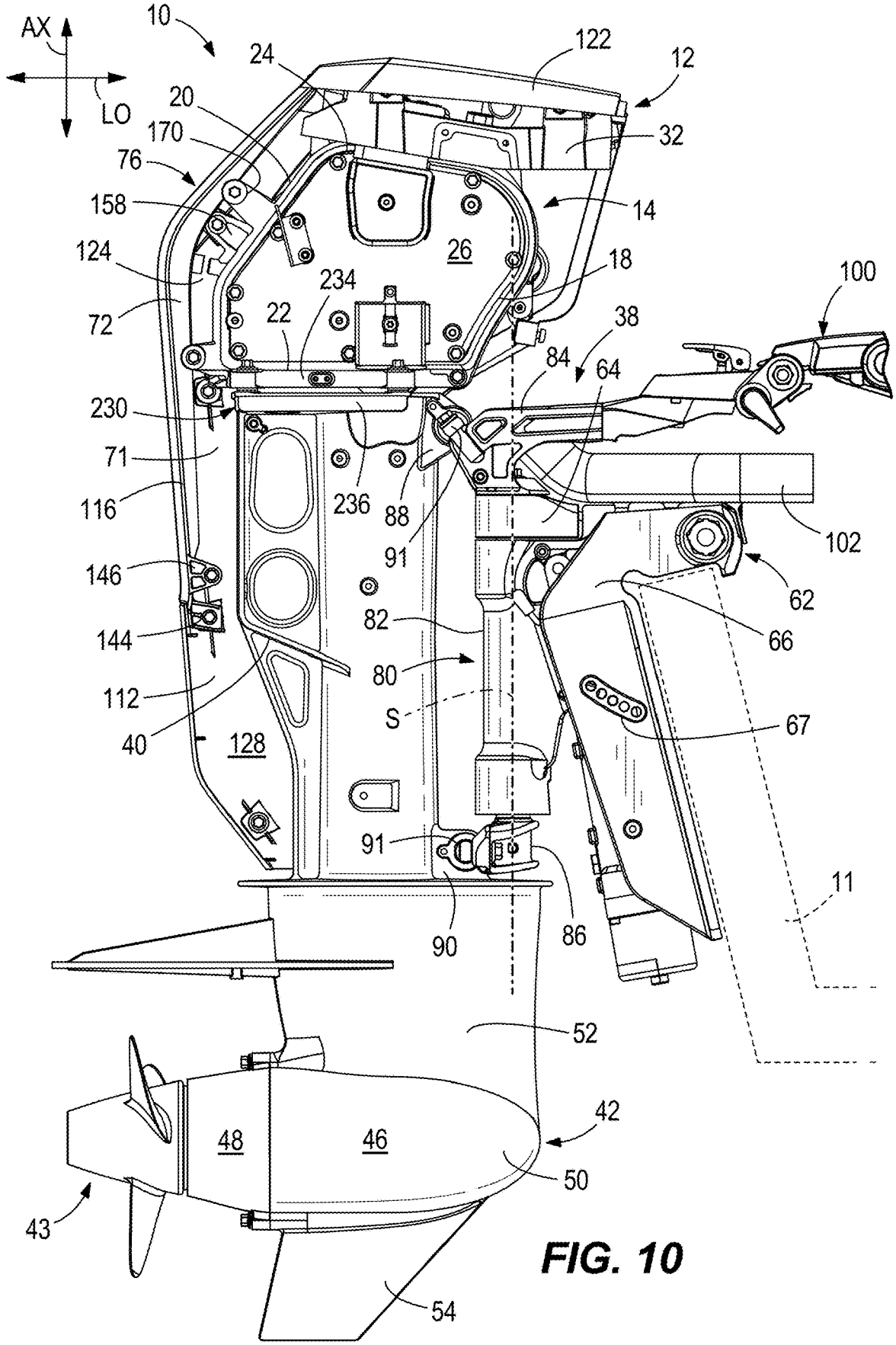
FIG. 10 is a starboard side view of the marine drive of FIG. 9 with the starboard cowl panel and the upper and lower front cowl panels removed.

FIG. 1 depicts a marine drive 10 for propelling a marine vessel in a body of water. In the illustrated embodiment, the marine drive 10 extends from top to bottom along a first axis in an axial direction AX, from front to back along a second axis in a longitudinal direction LO which is perpendicular to the axial direction AX, and from side to opposite side along a third axis in a lateral direction LA which is perpendicular to the axial direction AX and perpendicular to the longitudinal direction LO. FIG. 1 only depicts certain portions of the marine drive 10. As illustrated in FIG. 10, the marine drive 10 is attachable to the transom 11 of the marine vessel via a transom bracket assembly 38 and includes a torpedo housing 42 which supports a propulsor 43 for propelling the marine drive 10 in the water.

Referring to FIGS. 1-3 and 10, the illustrated marine drive 10 is an outboard motor having an upper unit 30 and a lower unit 34 connected to and suspended from the upper unit 30. As discussed in further detail below, a cowling 70 is suspended from the upper unit 30 and includes a cowl body 72 and a service lid 74 which encloses a service tray 32 and a service compartment 76 (FIG. 11) within the cowl body 72 at the top of the upper unit 30.

The upper unit 30 includes a supporting frame 12 for rigidly supporting the various components of the marine drive 10 with respect to the marine vessel. The supporting frame 12 has a frame body 14 with generally open port and starboard sides 16, a front side 18, a rear side 20, a bottom end 22, and an upper end 24. The frame body 14 defines an interior frame cavity 26 accessible via the open port and starboard sides 16 and configured to house at least one internal component of the marine drive 10. One such component is the power entry module (PEM) 28, which is coupled to the frame body 14 within the interior frame cavity 26 thereof. The PEM 28 is configured for regulate/control the current and voltage supplied to the marine drive 10 and to power the propulsor 43 and/or other components of the marine drive 10. A service tray 32 is coupled to the upper end 24 of the frame body 14 and may support at least one serviceable component, and/or a component used when servicing and/or transporting the marine drive 10. At least one of the serviceable components may be removably coupled to the service tray 32. Additionally or alternatively, some embodiments of a marine drive may include a supporting frame with a service tray that is integrally formed with the frame body.

Figure 2:
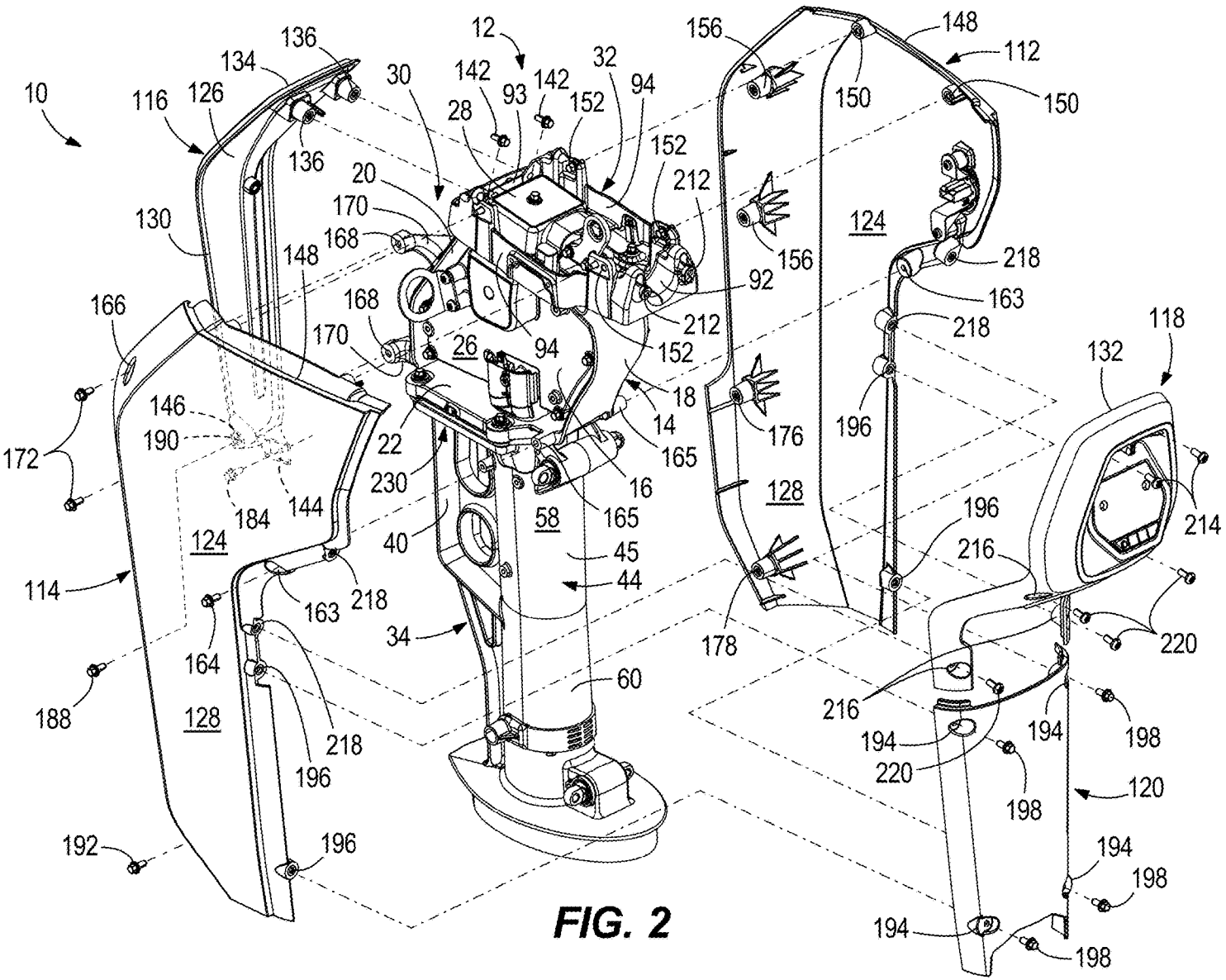
FIG. 2 is an exploded perspective view of the marine drive of FIG. 1.
Figure 3:
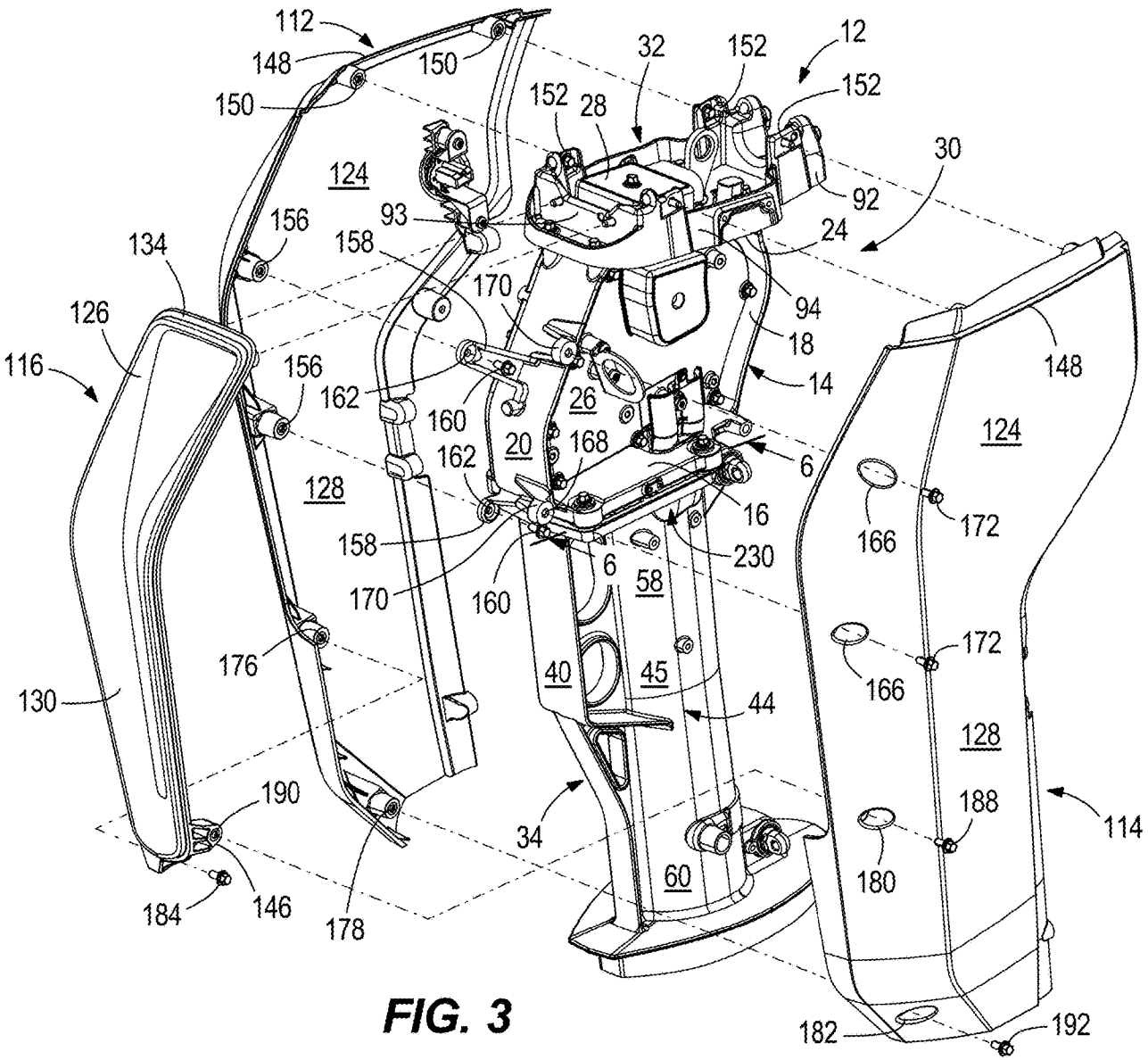
FIG. 3 is another exploded perspective view of the marine drive of FIG. 2.
Figure 6:
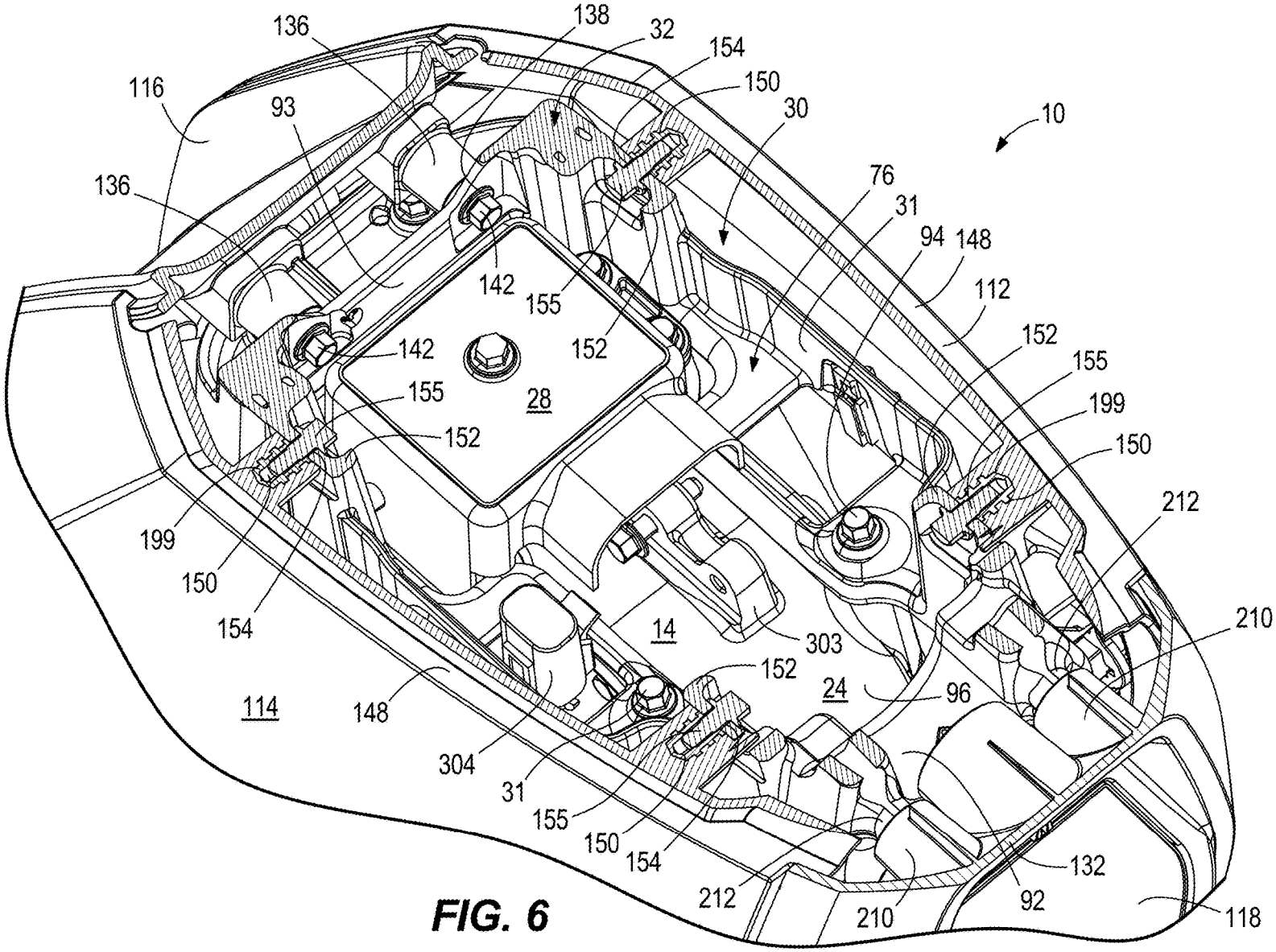
FIG. 6 is a view of section 6-6, taken in FIG. 1.
Figure 11:
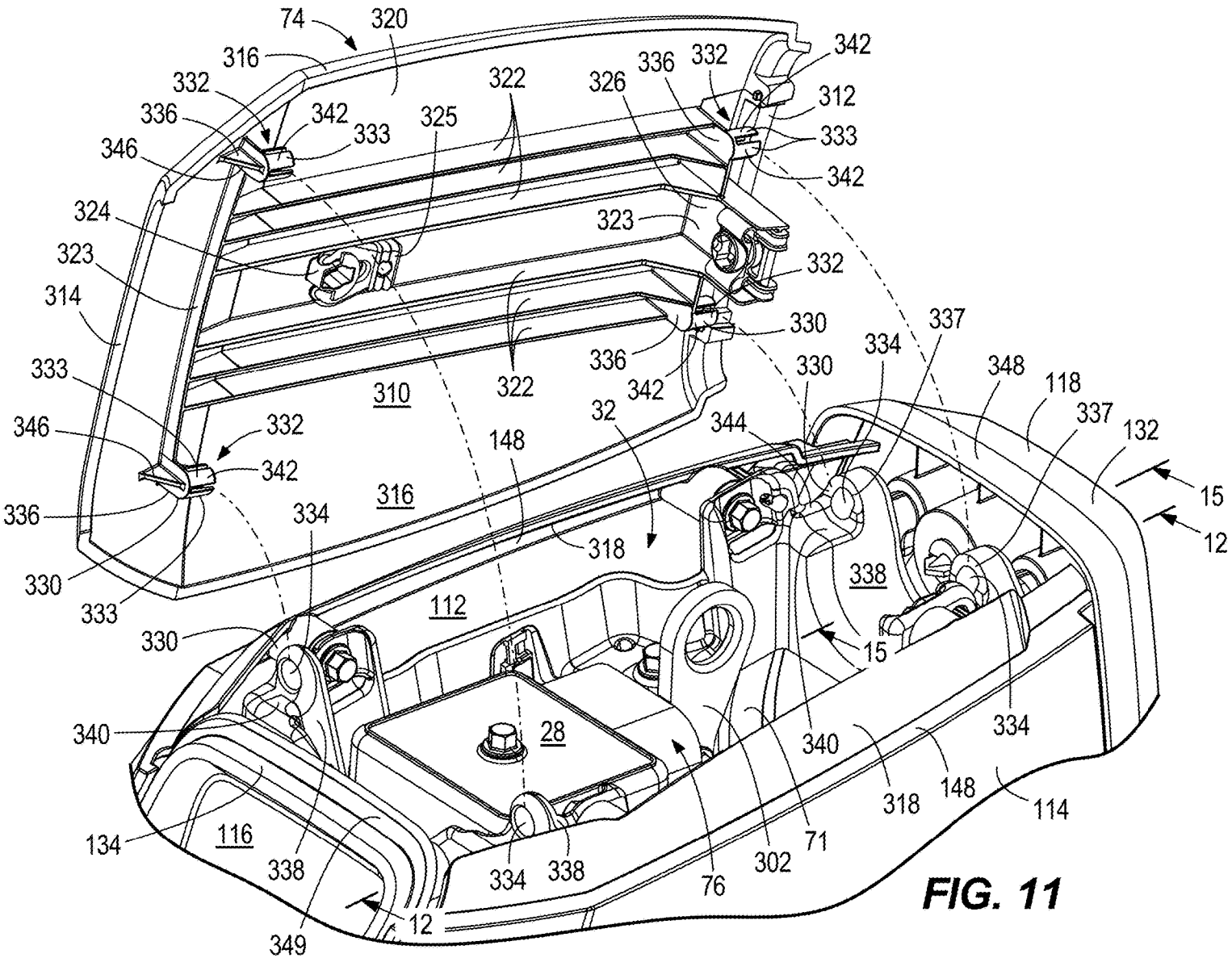
FIG. 11 is a perspective view of the service lid and service compartment of the marine drive of FIG. 10.

Referring to FIGS. 2, 3, and 6, the service tray 32 includes a perimeter wall with a front side 92, a back side 93, opposing lateral port and starboard sides 94 extending between the front and back side 92, 93, and a bottom surface 95. Fasteners 31 (FIG. 6) extend through the bottom surface 95 to secure the service tray 32 to the upper end 24 of the frame body 14. Openings 96 in the bottom surface 95 provide access to the frame body 14 and allow portions of the supporting frame 12 and/or the components to extend upwards into the service compartment 76. For example, as illustrated in FIG. 11, a lifting eye 302 is coupled to a lifting eye bracket 303 (FIG. 6) and extends upwards through an opening 96 in the service tray 32 and into the service compartment 76.

With continued reference to FIGS. 1-3 and 10, the lower unit 34 is disposed below the upper unit 30 in the axial direction AX. In the illustrated embodiment, the lower unit 34 is coupled to and suspended from the upper unit 30 by a novel vibration dampening joint 230 configured to limit the transfer of vibrations from the lower unit 34 to the upper unit 30, as discussed in further detail below. The lower unit 34 includes an extension leg 44 extending downward from the upper unit 30 to a torpedo housing 42 that supports the motor (not shown) and a propulsor 43 configured to be driven by the motor to propel the marine vessel in the water. The extension leg 44 is connected to the bottom end 22 of the supporting frame 12 and includes an elongated leg body 45 that extends from a top end 58 of the extension leg 44 to a bottom end 60 of the extension leg 44. Structural members 40 are formed along a back side of the leg body 45 from the top end 58 to the bottom end 60 of the extension leg 44. An interior passage 59 (FIG. 5) extends vertically through the leg body 45 between the top and bottom ends 58, 60 of the extension leg 44. The interior passage 59 provides an at least partially sealed passageway for a wire, cable, and/or any other type of connector to extend from the upper unit 30 to the torpedo housing 42 through the leg body 45.

Referring to FIG. 10, the torpedo housing 42 is positioned at the bottom end 60 of the extension leg 44. In some embodiments, the torpedo housing 42 may be coupled, directly or indirectly, to the extension leg 44, while other embodiments may be configured with a torpedo housing 42 that is integrally formed with the extension leg 44. The torpedo housing 42 has a front housing portion 46 and a rear housing portion 48 that are mated together and define a motor cavity (not shown) containing the motor (not shown) and related componentry. In the illustrated embodiments, the motor is an electric motor powered by batteries (not shown) that may be secured to the upper unit 30 or positioned at a location remote from the marine drive 10, such as in the marine vessel. The front housing portion 46 has a nosecone 50 with a smooth outer surface which transitions to an upwardly extending stem 52 and a downwardly extending skeg 54. The stem 52 extends upwards to the bottom end 60 of the extension leg 44 and is connected thereto. Similarly to the leg body 45 of the extension leg 44, the stem 52 has a vertically extending interior passage (not shown) through which a wire, cable, and/or other connectors may extend. The interior passage through the stem 52 is generally aligned with the interior passage 59 through the extension leg 44. Thus, connectors may extend through the extension leg 44 and stem 52 from the upper unit 30 to the torpedo housing 42. This may be useful, for example to provide power and/or control signals from a battery, controller, or other component in the upper unit 30 or on the marine vessel to the torpedo housing 42, for example, to provide electricity to the electric motor and/or for controlling the electric motor.

Referring to FIG. 10, the marine drive 10 is supported relative to the transom 11 of the marine vessel by a transom bracket assembly 38, which includes a transom bracket 62 configured to be fixed to the transom 11 and a swivel bracket 64 pivotably coupled to the transom bracket 62. The transom bracket 62 has a pair of C-shaped arms 66 which fit over the top of the transom 11 and a pair of threaded, plunger-style clamps (not shown) which clamp the C-shaped arms 66 to the transom 11. The swivel bracket 64 is pivotable with respect to the C-shaped arms 66 about a pivot shaft (not shown) that laterally extends through the forward upper ends of the C-shaped arms 66, thereby defining a trim axis that is generally parallel to the lateral axis LA. Pivoting of the swivel bracket 64 about the pivot shaft trims the marine drive 10 relative to the marine vessel, for example out of and/or back into the body of water in which the marine vessel is operated. A selector bracket 67 having holes is provided on at least one of the C-shaped arms 66. Holes respectively become aligned with a corresponding mounting hole on the swivel bracket 64 at different selectable trim positions for the marine drive 10. A selector pin (not shown) can be manually inserted into the aligned holes to thereby lock the marine drive 10 in place with respect to the swivel bracket 64.

With continued reference to FIG. 10, the marine drive 10 is movably connected to the transom bracket assembly 38 by a swivel assembly 80 that defines a steering axis S about which the marine drive 10 may pivot relative to the transom bracket assembly 38. The swivel assembly 80 includes a vertically extending swivel tube 82 that is connected to the swivel bracket 64 and a cylindrical swivel member (not shown) that is rotatably received in the swivel tube 82 and extends from a top end of the swivel tube 82 to an opposite bottom end thereof. The top end the swivel member is rigidly connected to a steering arm 84 and the bottom end of the swivel member is rigidly secured to a lower swivel bracket 86. The steering arm 84 and the lower swivel bracket 86 are respectively secured to an upper yoke 88 and a lower yoke 90 formed on the front side of the leg body 45 of the extension leg 44. The swivel member, the steering arm 84, the lower swivel bracket 86, and the marine drive 10 are pivotable together about the steering axis S. A tiller arm 100 (partially shown in FIG. 10) is connected to the forward end of the steering arm 84 and may be used to steer the marine drive 10 with respect to the marine vessel. Additionally or alternatively, some embodiments of a marine drive 10 may be configured with any other suitable apparatus and/or system for steering a marine drive with respect to a marine vessel.

Some embodiments of a marine drive 10 may include a vibration isolating connector that couples the marine drive to the swivel member. For example, as described in U.S. patent application Ser. No. 18/079,374, which is hereby incorporated by reference, the illustrated marine drive 10 includes vibration isolating members 91 that extend through a laterally extending through-bore in the upper and lower yokes 88, 90 and are configured to be secured to the steering arm 84 and the lower swivel bracket 86. Each vibration isolating member 91 includes an elastomeric deformable sleeve (not shown) that isolates the upper and lower yokes 88, 90 from the steering arm 84 and the lower swivel bracket 86. Thus, the vibration isolating members 91 support the marine drive 10 on the transom bracket assembly 38 via the elastomeric deformable sleeve of the vibration isolating members 91 such that all vibrations emanating from the marine drive 10 are transferred to the elastomeric deformable sleeves before being transferred to the transom bracket assembly 38. This may be useful, for example, in order to reduce problematic noise created by the vibrations, and/or to reduce the force between the marine drive 10 and the transom bracket assembly 38 in the event that the marine vessel, the marine drive 10 or the transom bracket assembly 38 are struck by an object. The properties of the elastomeric deformable sleeve (e.g., the material composition and properties, shape, thickness, etc.) may be configured to provide a desired amount of vibration dampening while maintaining a somewhat rigid connection so that thrust generated by the propulsor 43 is efficiently transferred to the marine vessel to propel the marine vessel through the water.

As previously mentioned, a cowling 70 is fixed to and surrounds most or all of the frame body 14 of the supporting frame 12. Referring to FIGS. 1-3, the cowling 70 has a cowl body 72 with a plurality of cowl portions (i.e., cowl panels 112-120) that together define a cowl interior 71 (FIG. 10) in which a portion of the supporting frame 12 is enclosed and various components of the marine drive 10 are disposed. The cowling 70 includes an upper portion 104 which is coupled to and encloses the upper unit 30 of the marine drive 10 and a lower portion 106 which is spaced apart from but encloses an upper portion 35 of the lower unit 34 of the marine drive 10. Thus, the cowling 70 is suspended on the upper unit 30 apart from (i.e., not directly connected to) the lower unit 34. This may be useful, for example, to prevent the direct transfer of vibrations from the lower unit 34 to the cowling 70, as further described herein below.

Referring to FIGS. 2 and 3, the cowling 70 includes a port side panel 112, a starboard side panel 114, a rear panel 116, an upper front panel 118, a lower front panel 120, and a service lid 74 (FIG. 11) positioned on the service tray 32. The upper portion 104 (FIG. 1) of the cowling 70 includes the upper front panel 118, top portions 124 of the port and starboard side panels 112, 114, a top portion 126 of the rear panel 116, and the service lid 74 (FIG. 11). The lower portion 106 (FIG. 1) of the cowling 70 includes the lower front panel 120, bottom portions 128 of the port and starboard side panels 112, 114, and a bottom portion 130 of the rear panel 116.

Each of the cowl panels 112-120 is coupled to the upper unit 30 of the marine drive 10 and/or to at least one of the other cowl panels 112-120. Referring to FIGS. 2, 3, and 6, the rear panel 116 extends along a back side of the marine drive 10 and is coupled to a back side 93 of the service tray 32 and to the port and starboard side panels 112, 114. Two mounting openings 136 are formed proximate a top edge 134 of the top portion 126 of the rear panel 116. Each of the mounting openings 136 corresponds to a through-bore 138

Figure 4:
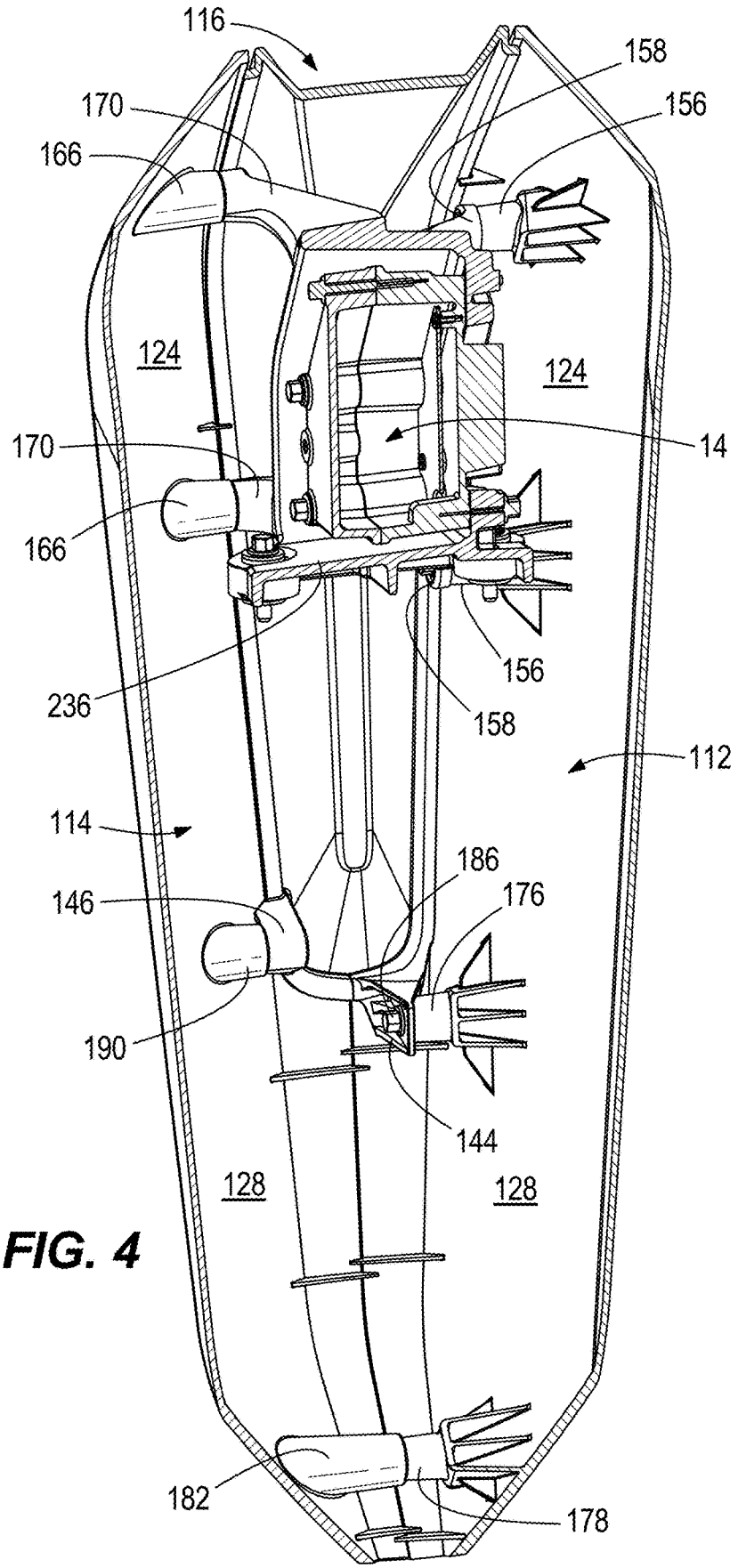
FIG. 4 is a view of section 4-4, taken in FIG. 1.

(FIG. 6) formed through the back side 93 (FIG. 6) of the service tray 32. Fasteners 142 can be inserted through the smooth through-bores 138 in the back side 93 to engage the corresponding threaded mounting openings 136, thereby suspending the rear panel 116 from the service tray 32 of the upper unit 30. Referring to FIGS. 2-4, the rear panel 116 includes a port side mounting bracket 144 and a starboard side mounting bracket 146 are positioned proximate the lower edge of the bottom portion 130 thereof. The port and starboard side mounting brackets 144, 146 extend forward from the rear panel 116 and are configured for coupling the rear panel 116 to the port and starboard side panels 112, 114 respectively.

The port side panel 112 and the starboard side panel 114 are each connected to the upper unit 30 (e.g., the service tray 32 and the frame body 14 of the supporting frame 12), and to each other. Referring to FIGS. 2, 3, and 6, the port and starboard side panels 112, 114 each include two mounting openings 150 spaced along the top edge 148 of the top portion 124 of the side panels 112, 114. Two mounting brackets 152 are positioned proximate each lateral side of the service tray 32. The mounting brackets 152 each include a smooth through-bore 154 (FIG. 6) positioned in alignment with the mounting openings 150 formed along the top edges 148 of the port and starboard side panels 112, 114. As illustrated in FIG. 6, fasteners 155 extend through the through-bores 154 to engage the threaded mounting openings 150 in order to couple the port and starboard side panels 112, 114 to the sides 94 of the service tray 32.

The port and starboard side panels 112, 114 are also coupled to the front side 18 of the frame body 14 proximate the bottom end 22 of the frame body 14. As illustrated in FIG. 2, the port side panel 112 and the starboard side panel 114 each include a through-bores 163 positioned proximate an angled portion of the front edge of the side panels 112, 114. Fasteners 164 extend through the through-bores 163 in the port and starboard side panels 112, 114 to engage corresponding threaded mounting opening 165 (see also FIGS. 7 and 8) formed in the bottom end 22 of the supporting frame body 14 proximate the front side 18 of the frame body 14.

Referring to FIGS. 2-4, the top portions 124 of the port and starboard side panels 112, 114 include mounting features spaced vertically along the back edges of the side panels 112, 114. The mounting features are configured for coupling the side panels 112, 114 to the rear side 20 of the frame body 14. In the illustrated embodiments, the mounting features include different combinations of through-bores, threaded mounting openings, and fasteners. In some of the Figures, the actual openings into the through-bores and/or mounting openings are obscured by other components. Thus, in some cases, a through-bore and/or a mounting opening may be identified in the Figures with a reference numeral pointing to a radially outer surfaces of the material in which through-bore and/or a mounting opening is formed.

With continued reference to FIGS. 2-4, the port side panel 112 includes two mounting openings 156 which correspond to port side mounting brackets 158 that extend rearwardly from the rear side 20 of the frame body 14. Fasteners 160 (FIG. 3) extend through through-bores 162 (FIGS. 3, 7, and 8) in the port side mounting brackets 158 and engage the mounting openings 156 to secure the port side panel 112 to the supporting frame 12. The starboard side panel 114 includes two through-bores 166 spaced along the back edge thereof. Each through-bore 166 is positioned in alignment with a corresponding mounting opening 168 (FIGS. 2, 7, and 8) formed in starboard side mounting brackets 170 that extend rearwardly from the rear side 20 of the frame body 14. Fasteners 172 extend through the through-bores 166 in the starboard side panel 114 and engage the corresponding mounting openings 168, thereby coupling the starboard side panel 114 to the supporting frame 12.

Referring to FIGS. 2-5, the bottom portions 128 of the port and starboard side panels 112, 114 similarly include mounting features spaced vertically along the back edges thereof. The bottom portion 128 of the port side panel 112 includes upper and lower mounting openings 176, 178 formed along the back edge thereof, and the bottom portion 128 of the starboard side panel 114 includes upper and lower through-bores 180, 182 formed along the back edge thereof. The upper mounting opening 176 in the port side panel 112 and the upper through-bore 180 in the starboard side panel 114 are positioned in alignment with the port side mounting bracket 144 and the starboard side mounting bracket 146 of the rear panel 116, respectively. A fastener 184 extends through a smooth through-bore 186 (FIG. 5) formed in the port side mounting bracket 144 and engages the upper mounting opening 176 in the bottom portion 128 of the port side panel 112 to couple the port side panel 112 to the rear panel 116. Another fastener 188 extends through the upper through-bore 180 in the bottom portion 128 of the starboard side panel 114 to engage a corresponding mounting opening 190 in the starboard side mounting bracket 146 to couple the starboard side panel 114 to the rear panel 116. Furthermore, the port and starboard side panels 112, 114 are secured to each other by a fastener 192, which extends through the lower through-bore 182 in the starboard side panel 114 to engage the lower mounting opening 178 in the port side panel 112.

Figure 5:
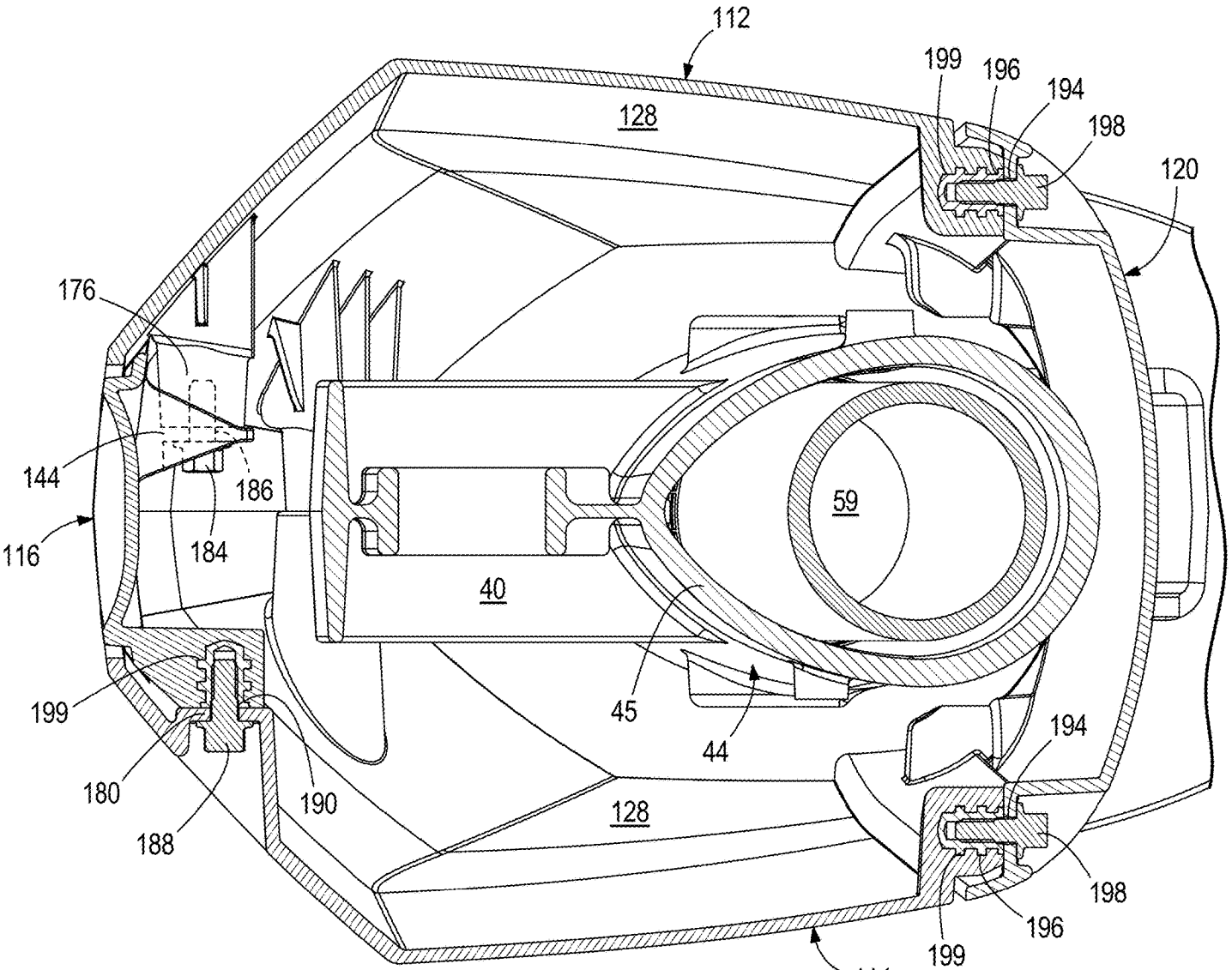
FIG. 5 is a view of section 5-5, taken in FIG. 1.

Referring to FIGS. 2 and 5, the lower front panel 120 includes two through-bores 194 spaced laterally along the port and starboard lateral sides of the lower front panel 120. Each of the through-bores 194 in the lower front panel 120 is aligned with a corresponding mounting opening 196 positioned along the front edge of the bottom portion 128 of the port or starboard side panel 112, 114. Fasteners 198 are inserted through the through-bores 194 to engage the mounting openings 196, thereby coupling the lower front panel 120 to the bottom portions of the port and starboard side panels 112, 114.

Referring to FIGS. 2 and 6, the upper front panel 118 is coupled to the front side 92 of the service tray 32 and to the top portions 124 of the port and starboard side panels 112, 114. Two through-bores 210 (FIG. 6) are spaced laterally along proximate a top edge 132 of the upper front panel 118. Each through-bore 210 in the upper front panel 118 is aligned with a corresponding mounting opening 212 formed in the front side 92 of the service tray 32. Fasteners 214 (FIG. 2) are inserted through the through-bores 210 to threadedly engage the corresponding mounting opening 212, thereby suspending the upper front panel 118 from the service tray 32.

Referring to FIG. 2, two additional through-bores 216 (see, also, FIG. 1) are formed through the upper front panel 118 proximate both the port and starboard lateral sides thereof. The two through-bores 216 on the starboard side of the upper front panel 118 are aligned with corresponding mounting openings 218 formed along a front edge of the starboard side panel 114 and the two through-bores 216 on the port side of the upper front panel 118 are aligned with corresponding mounting openings 218 formed along the front edge of the port side panel 112. Fasteners 220 extend through each of the through-bores 216 to engage the corresponding mounting openings 218, thereby coupling the upper front panel 118 to the port and starboard side panels 112, 114.

In the illustrated embodiment, the cowl panels 112-120 are coupled to the upper unit 30 by a combination of through-bores, threaded mounting openings, and fasteners extending through the through-bores to engage the threaded openings. It should be appreciated that pairs of corresponding through-bores and mounting openings may be interchanged. For example, a connection including a through-bore in a cowl panel and a mounting opening in the supporting frame may be swapped so that the through-bore bore is formed in the supporting frame and the mounting opening is in the cowl panel. Furthermore, the illustrated threaded mounting openings in the cowl panels 116-120 and the supporting frame 12 may include a threaded insert 199 (see, e.g., FIG. 5) fixed in an unthreaded hole. Some embodiments, however, may include at least one mounting opening with threads formed in the material of the cowl panels 116-120 and/or the supporting frame 12 without a threaded insert 199.

As previously mentioned, embodiments of a marine drive 10 may include a vibration isolating connection securing the lower unit 34 to the upper unit 30. For example, the illustrated marine drive 10 includes a vibration dampening joint 230 which couples the lower unit 34 to the upper unit 30 so as to vibrationally isolate the upper unit 30 and the cowling 70 from the lower unit 34 and the marine vessel (which is connected to the lower unit 34 via the transom bracket assembly 38).

Figure 7:
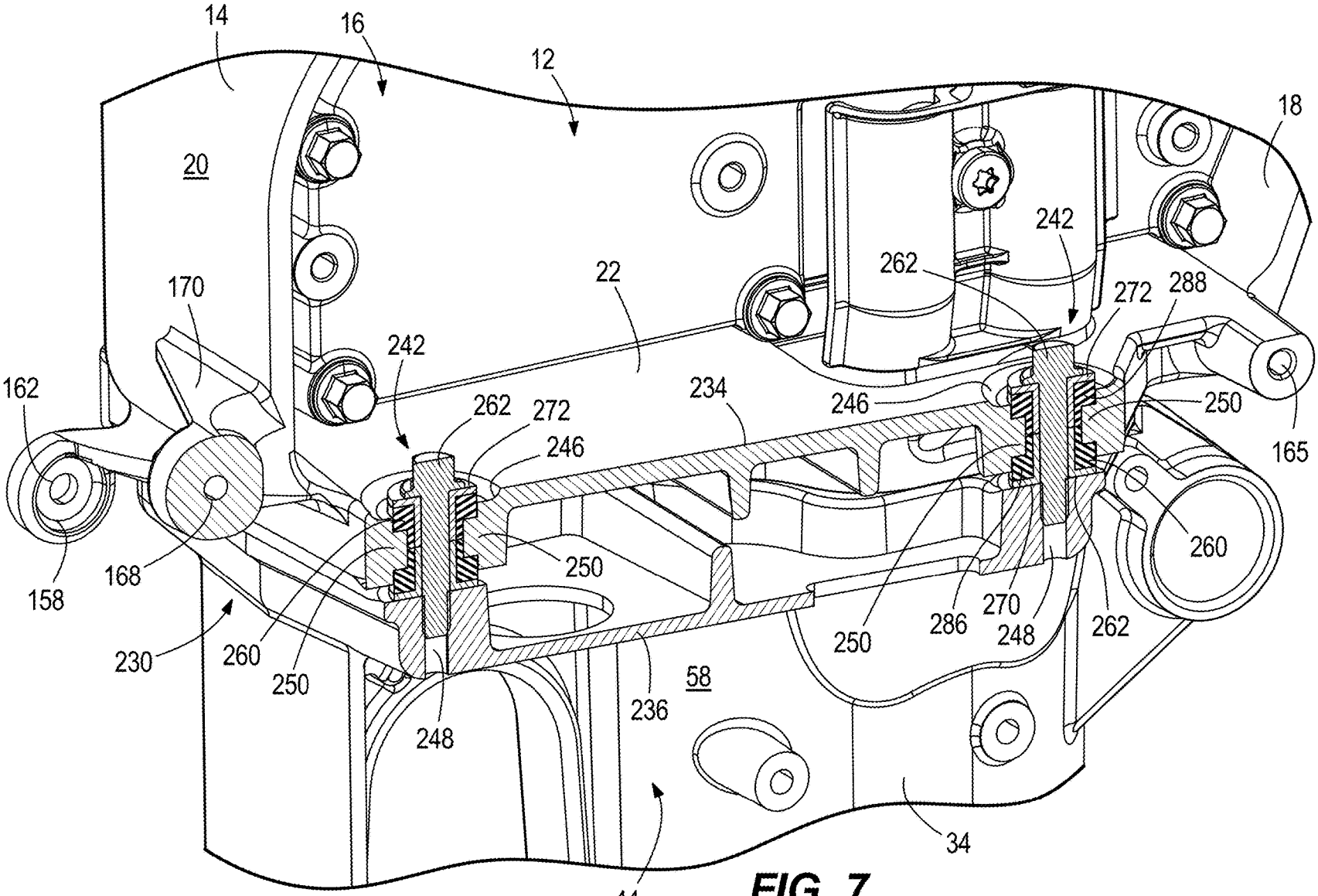
FIG. 7 is a view of section 6-6, taken in FIG. 3.
Figure 8:
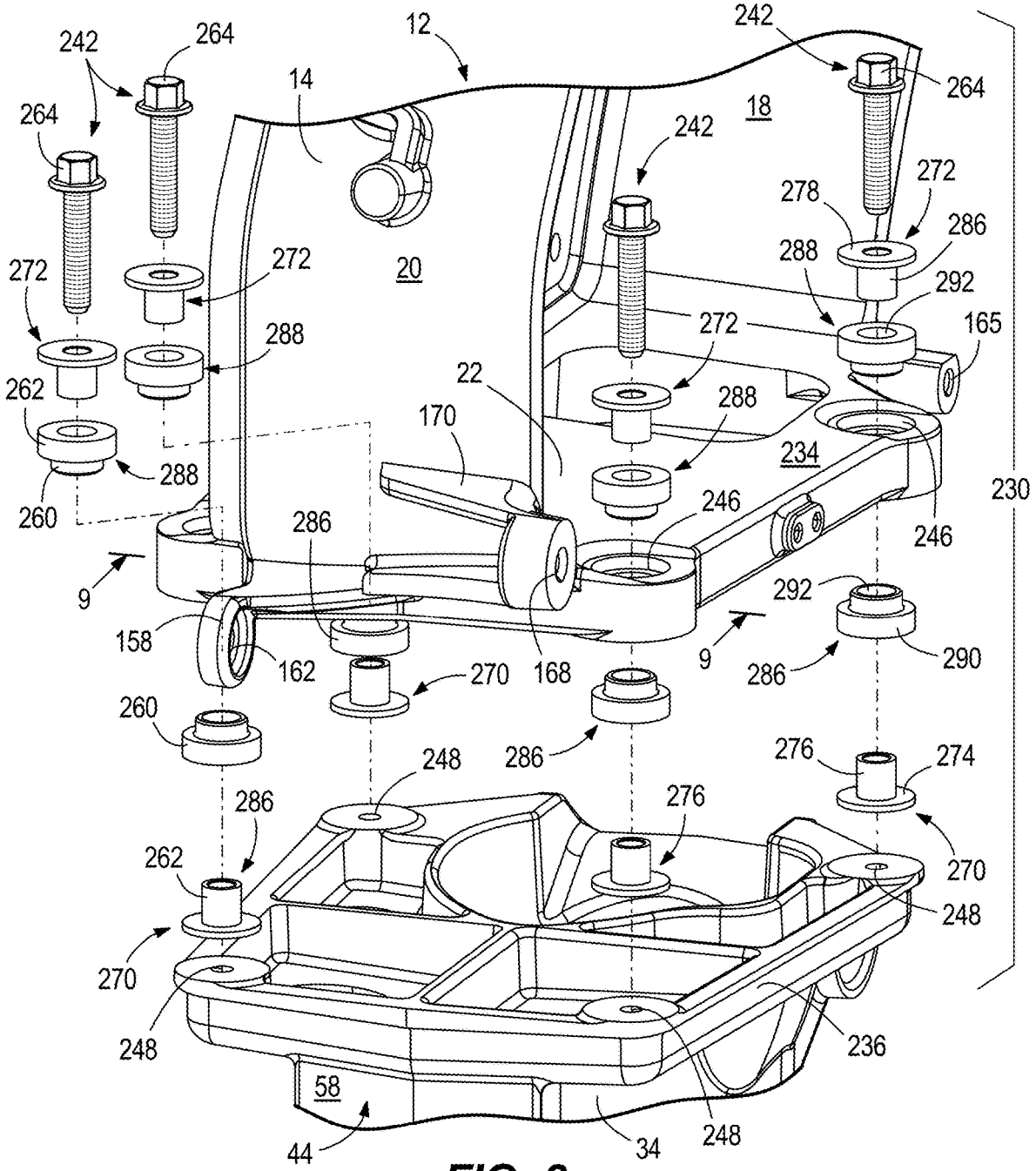
FIG. 8 is an exploded perspective view of the vibration dampening joint connecting the upper unit to the lower unit of the marine drive of FIG. 7.
Figure 9:
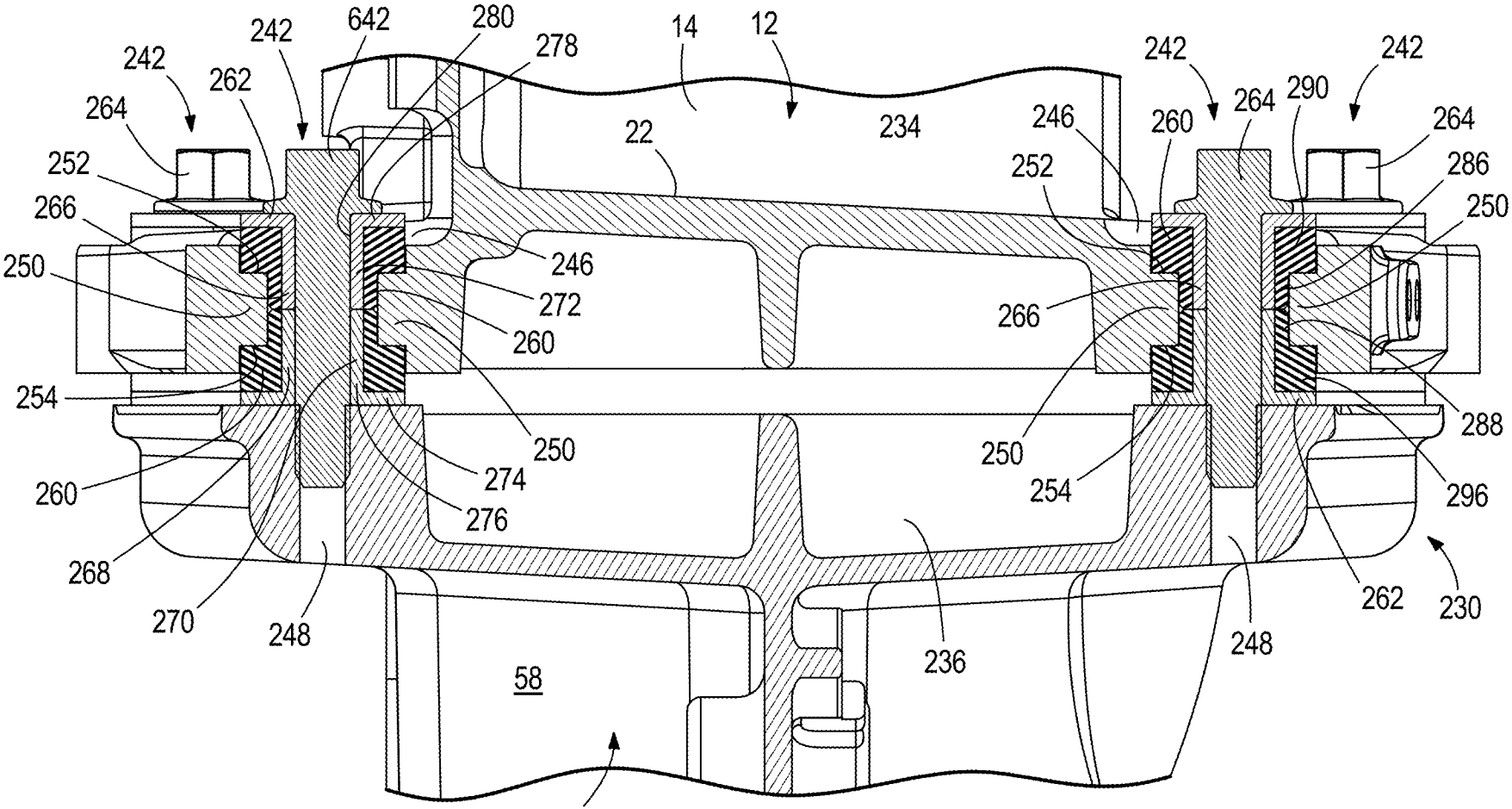
FIG. 9 is a view of section 9-9, taken in FIG. 8.

Referring to FIGS. 7-9, the supporting frame 12 has a lower mounting flange 234 formed at a lower end 232 of the frame body 14 and the extension leg 44 includes an upper mounting flange 236 that is positioned at the top end 58 of the lower unit 34 and faces the lower mounting flange 234. A radially outer profile of the upper mounting flange 236 generally matches the radially outer profile of the lower mounting flange 234. A plurality of holes 246 are formed through the lower mounting flange 234, and each hole 246 in the lower mounting flange 234 is arranged in vertical axial alignment with a corresponding bore 248 formed through the upper mounting flange 236. In the non-limiting illustrated embodiments, the holes 246 in the lower mounting flange 234 are configured as double counterbored holes 246. That is, the holes 246 in the lower mounting flange 234 are counterbored from both sides so that an annular ring 250 having an upper surface 252 and a lower surface 254 (FIG. 9) is formed around the interior diameter of the holes 246. In other embodiments, at least one of the bores 248 formed through the upper mounting flange 236 may be configured as a counterbored hole, and/or at least one hole 246 in the lower mounting flange 234 may not be a counterbored hole.

The novel vibration dampening joint 230 couples the lower mounting flange 234 and the upper mounting flange 236, thereby coupling the extension leg 44 to the supporting frame 12. The vibration dampening joint 230 includes a plurality of isolating connector assemblies 242 spaced apart around the lower mounting flange 234 and the upper mounting flange 236. Each isolating connector assembly 242 engages one of the counterbored holes 246 in the lower mounting flange 234 and the corresponding one of the bores 248 in the upper mounting flange 236. In the non-limiting embodiment of FIG. 2, the vibration dampening joint 230 includes four isolating connector assemblies 242. Other embodiments may include a different number of isolating connector assemblies 242, and/or at least one isolating connector assembly 242 may be arranged in a different position than those of the illustrated embodiments.

With continued reference to FIGS. 7-9, each isolating connector assembly 242 includes an elastomeric member 260, a compression limiter 262, and a fastener 264. The fastener 264 extends through the elastomeric member 260 and the compression limiter 262 and couples the lower mounting flange 234 and the upper mounting flange 236 together. The compression limiters 262 are rigid members having a rigid cylinder 266 with a bore 268 through which the fastener 264 extends. In the non-limiting illustrated embodiments, the compression limiters 262 include a first limiter portion 270 and a second limiter portion 272. The first limiter portion 270 includes a first annular flange 274 and a first cylinder half 276 and is located between the upper mounting flange 236 of the extension leg 44 and the lower mounting flange 234 of the supporting frame 12. The second limiter portion 272 includes a second annular flange 278 and a second cylinder half 280 and is located on an opposite side of the upper mounting flange 236 of the extension leg 44. The first limiter portion 270 and the second limiter portion 272 oppose each other such that the first and second cylinder halves 276, 280 abut each other to form the rigid cylinder 266. Together, the first limiter portion 270 and second limiter portion 272 define an axial space between the first and second annular flanges 274, 278 in which elastomeric member 260 is located, as illustrated in FIGS. 7-9.

The elastomeric member 260 has a first resilient portion 286 located between the upper mounting flange 236 and the lower mounting flange 234 and a second resilient portion 288 located on an opposite side of the lower mounting flange 234 relative to the first resilient portion 286. The first resilient portions 286 and the second resilient portions 288 are configured to be received in the counterbored holes 246. Referring to FIGS. 7-9, an annular flange 290 of the first resilient portion 286 abuts the lower surface 254 of the annular ring 250 and an annular flange 290 of the second resilient portion 288 abuts the upper surface 252 of the annular ring 250. The first and second resilient portions 286, 288 each include a bore 292 configured to respectively receive the first and second cylinder halves 276, 280 of the first and second limiter portions 270, 272. When assembled, the first resilient portion 286 is located between the first limiter portion 270 and the lower mounting flange 234 of the supporting frame 12 and the second resilient portion 288 is located between the second limiter portion 272 and the lower mounting flange 234 of the supporting frame 12. Thus, the elastomeric member 260 is clamped in the axial space between first annular flange 274 and the second annular flange 278.

Referring to FIGS. 7-9, to assemble the vibration dampening joint 230 and couple the supporting frame 12 to the lower unit 34, the elastomeric members 260 are inserted into the counterbored holes 246 by placing the first resilient portions 286 in a bottom opening of a counterbored hole 246 and the second resilient portion 288 in a top opening of said counterbored hole 246. The compression limiters 262 are then received in the elastomeric members 260 by inserting the first cylinder halves 276 into the bores 292 of the first resilient portions 286 and the second cylinder halves 280 into the bores 292 of the second resilient portions 288. The fasteners 264 are then inserted into the elastomeric members 260 and the compression limiters 262 so that the fasteners 264 extend through the first limiter portion 270, the first resilient portion 286, the second limiter portion 272, and the second resilient portion 288. The fasteners 264 extend through the elastomeric members 260 and the compression limiters 262 to engage the bore 248 formed in the upper mounting flange 236. Tightening the fasteners 264 clamps the elastomeric members 260 between the extension leg 44 and the supporting frame 12 until engagement between the fasteners 264 and the compression limiters 262 prevents further tightening of the fasteners 264.

Tightening of the fastener 264 clamps the first resilient portion 286 between the first limiter portion 270 of the compression limiter 262 and the lower mounting flange 234, and the second resilient portion 288 is clamped between the second limiter portion 272 and the lower mounting flange 234. The axial space between the first and second annular flanges 274, 278 of the compression limiters 262 has a length preselected to prevent over compression of the elastomeric member 260 by the fastener 264. Thus, the compression limiters 262 prevent over tightening of the fasteners 264 to prevent over compression of the elastomeric member 260. The elastomeric members 260, which are clamped between the extension leg 44 and the supporting frame 12, advantageously limit the transfer of vibrations from the extension leg 44 to the supporting frame 12. All vibrations emanating from the electric motor and/or the propulsor 43 are transferred to the elastomeric members 260 before being transferred to the supporting frame 12, thereby reducing problematic noise and increasing overall noise quality. The compression limiters 262 prevent over clamping of the elastomeric member during assembly of the extension leg 44 and the torpedo housing 42. By limiting compression of the elastomeric members 269, a predetermined pressure can be loaded onto the elastomeric members. The predetermined load may be selected to limit the transmission of undesirable sound frequencies through the elastomeric members 260 while still supporting the loads needed for propulsion. This may be useful, for example, in order to lower aquatic noise levels to produce less disturbance to boaters, inhabitants, and/or wildlife.

As illustrated in FIG. 10, the vibration dampening joint 230 is approximately in vertical alignment with a guide conduit 102 configured to guide wires, cable, and/or other flexible connectors over the transom bracket 62 and into the cowling interior 71, for example, to connect to the PEM 28 or another electrical component. While the isolating connector assemblies 242 of the vibration dampening joint 230 allow some movement of the upper unit 30 relative to the lower unit 34 in the axial direction AX, the isolating connector assemblies 242 restrict movement of the upper unit 30 in the longitudinal direction LO and the lateral direction LA. This may be useful, for example, in order to limit motion of the upper unit 30 relative to the marine vessel to prevent the guide wires, cable, and/or other flexible connectors from being pulled out of the cowling 70.

Furthermore, as illustrated in FIG. 10, the cowling 70 is suspended from the upper unit 30 of the marine drive 10 and is not coupled to the lower unit 34 so that no vibrations emanating from the lower unit 34 are transferred directly to the cowling 70. Rather, vibrations are transferred to the cowling 70 via the vibration dampening joint 230 and the supporting frame 12. By rigidly coupling the cowl panels 112-122 to the service tray 32, the supporting frame body 14, and to each other without a direct connection to the lower unit 34, the mass of the cowling 70 is linked to the mass of the supporting frame 12. Vibrational energy transmitted to the upper unit 30 causes the cowling 70 to vibrate with the supporting frame 12, thereby effectively increasing the mass of the cowling 70 as compared to a cowling which is directly connected to the lower unit 34. The effective increase in mass has a dampening effect which reduces the intensity of vibrations experience by the cowling 70.

In the non-limiting illustrated embodiments, the isolating connector assemblies 242 are configured so that the elastomeric members 260 are clamped between the first and second annular flanges 274, 278 of the compression limiters 262 and the lower mounting flange 234. Other embodiments, however, may be differently configured. For example, a vibration isolating joint may include at least one connector assembly configured to clamp an elastomeric member between a compression limiter and the leg mounting flange. In such an embodiment, the first resilient portion may be clamped between first annular flange of the first limiter portion and the leg mounting flange and the second resilient portion may be clamped between second annular flange of the second limiter portion and the leg mounting flange.

Referring to FIGS. 11-14, embodiments of a marine drive 10 may include service lid 74 that encloses a service compartment 76 within the cowl body 72 at the top of the marine drive 10. The service lid 74 is positioned on the service tray 32 and can be removed from the supporting frame 12 in order to provide access to the service compartment 76. The illustrated service lid 74 is movable into and between a service position (FIGS. 11 and 12) in which the service lid 74 is removed from the cowl body 72 and the service compartment 76, an unregistered position (FIGS. 13 and 15) in which the service lid 74 at least partially covers the service compartment 76, and a registered position (FIGS. 14, 16, and 17) in which the service lid 74 is locked relative to the cowl body 72 and encloses the service compartment 76.

Referring to FIG. 11, the service lid 74 includes a body 310 that extends longitudinally from a front edge 312 to a rear edge 314 and laterally between opposite port and starboard lateral edge portions 316. The port and starboard lateral edge portions 316 turn downwardly towards the port side and starboard side panels 112, 114, respectively. Deflector lips 318 extend along the top edges 148 of the port and starboard side panels 112, 114. The deflector lips 318 are offset laterally inwards from the outer surfaces of the side panels 112, 114 and turn radially inwardly towards the cowl interior 71. When the service lid 74 is positioned on the supporting frame 12, the lateral edge portions 316 overlap the deflector lips 318, which may be useful in order to restrict the ingress of water into the service compartment 76.

A bottom surface 320 of the service lid 74 faces inward towards the service compartment 76 and may include structural members configured to increase the rigidity and strength of the service lid 74. For example, as illustrated in FIG. 11, the service lid 74 includes a plurality of ribs 322, 323 that extend along the bottom surface 320 of the service lid 74. The illustrated service lid 74 includes six longitudinal ribs 322 arranged in two sets of three of ribs 322. The ribs 322 extend from a rear lateral rib 323 formed proximate the rear edge 314 to a front lateral rib 323 proximate the front edge 312, which is formed by probe brackets 336, and a lock bracket 326 configured to support part of a locking device, as discussed in further detail below. Some embodiments may include a different number of ribs 322 and/or lateral ribs 323, and/or at least one rib 322, 323 may be differently positioned, differently sized, and/or have a different orientation than those of the illustrated embodiment. Additionally or alternatively, the ribs 322, 323 may be differently organized or grouped. In some embodiments, the service lid 74 may include a noise and/or vibration dampening material to reduce the intensity of noise emanating from the cowling 70. For example, some embodiments may be configured with a foam material (not shown) affixed to the bottom surface 320 of the service lid 74 between the ribs 322 or at any other location on the service lid 74. In addition to dampening noise, the inclusion of a foam material advantageously increases the buoyancy of the service lid so that the service lid 74 will float in water.

Referring to FIG. 11, between the two sets of ribs 322, the service lid 74 includes an attachment point 324 configured to be engaged by an engine lanyard clip 325 that may be used to enable operation of the marine drive 10 in the event that the original engine lanyard is not available. While the illustrated embodiment includes just the clip portion 325 of an engine lanyard, it should be appreciated that a complete spare engine lanyard may be secured to the attachment point 324. Additionally or alternatively, a service lid 74 may include an attachment point 324 for an engine lanyard clip 325 that is configured to retain the engine lanyard clip 325 in a different manner, and/or the attachment point 324 may be at a different location on the service lid 74. Further still, some embodiments may include an attachment point for an engine lanyard clip 325 that is located within the service compartment 76, for example on the service tray 32.

With continued reference to FIG. 11, the service lid 74 and the service tray 32 together include engagement devices 330 which facilitate engagement, sliding and registration of the service lid 74 relative to the supporting frame 12. The illustrated marine drive 10 includes four engagement devices 330 that each include a probe 332 on the bottom surface 320 of the service lid 74 and a recess 334 formed on the supporting frame 12. The recesses 334 are configured as longitudinally extending through-bores that extend through recess brackets 338 that positioned on the supporting frame 12. In the illustrated embodiment, the recess brackets 338 extend upwardly from the service tray 32. Other embodiments, however, may be configured with at least one recess 334 formed in another part of the supporting frame 12 and/or the cowling 70.

Figure 12:
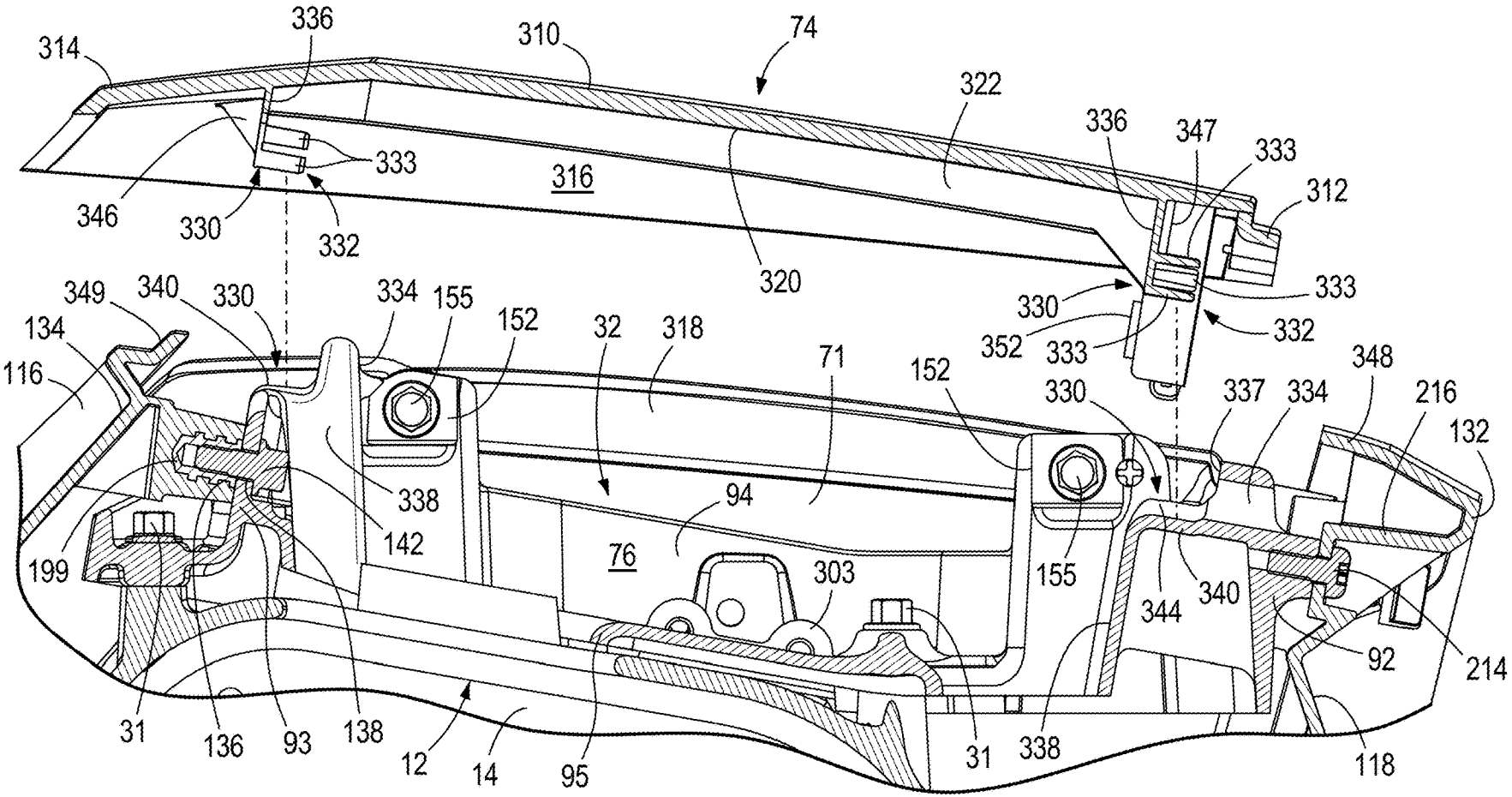
FIG. 12 is a view of section 12-12, taken in FIG. 11, with the service lid in the service position.
Figure 13:
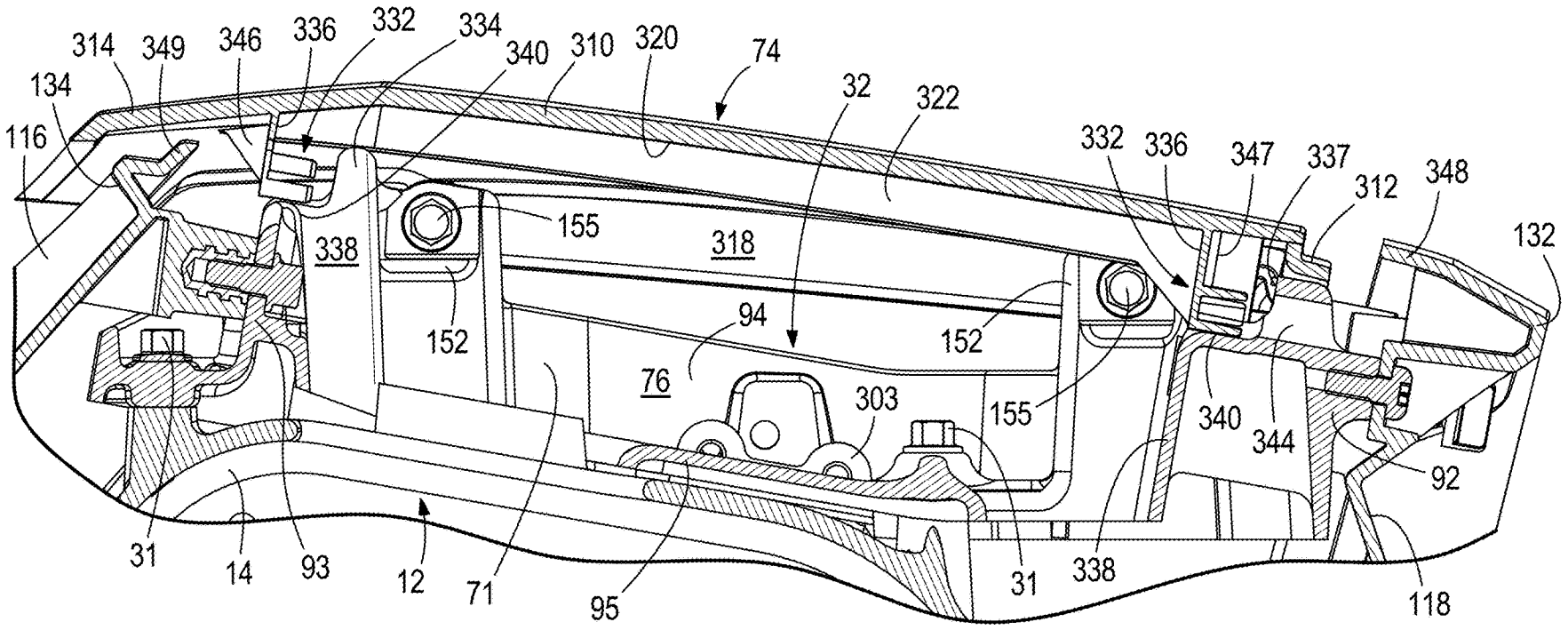
FIG. 13 is a view of section 12-12, taken in FIG. 11, with the service lid in the unregistered position.
Figure 14:
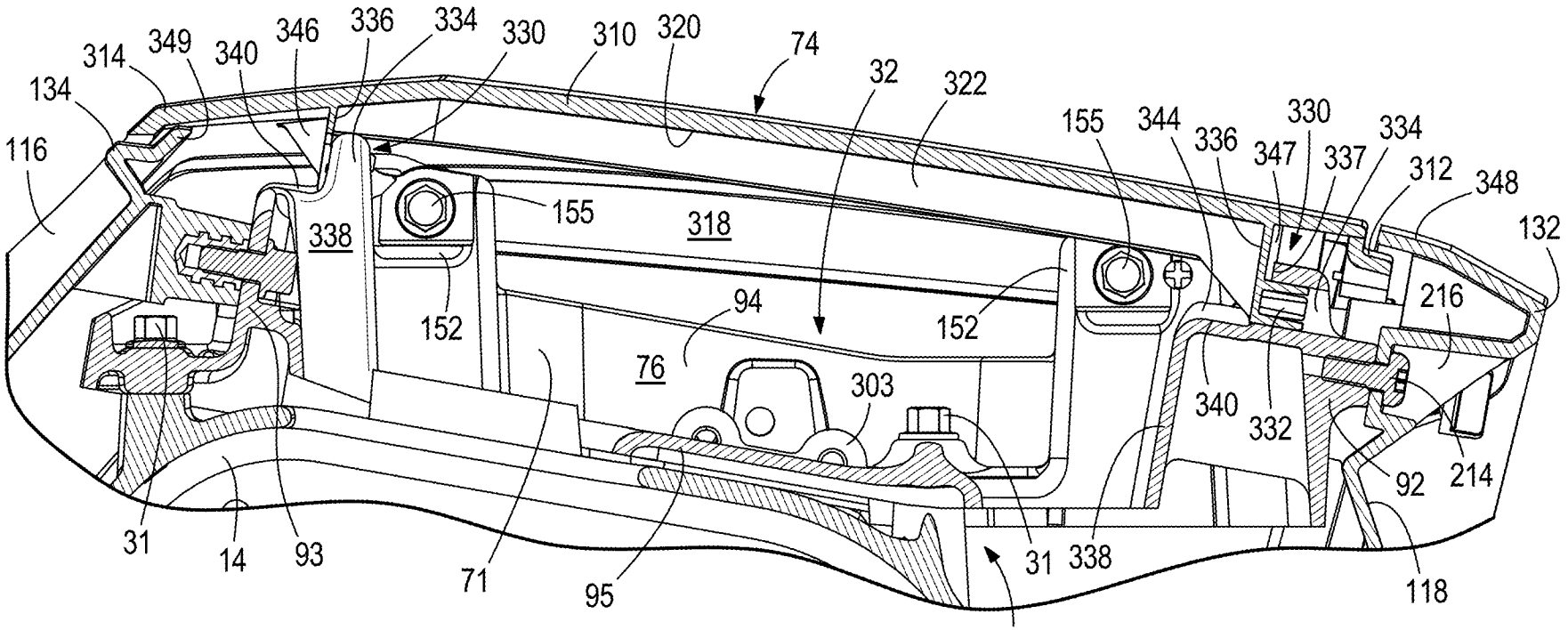
FIG. 14 is a view of section 12-12, taken in FIG. 11, with the service lid in the registered position.

The engagement devices 330 are configured to position and secure the service lid 74 to the supporting frame 12. In the embodiments of FIGS. 11-14, the marine drive 10 includes four engagement devices 330 that each include a probe 332 on the bottom surface 320 of the service lid 74 and a recess 334 formed on the supporting frame 12. Each probe 332 is connected to the service lid 74 by a probe bracket 336 that projects downward from the bottom surface 320. The probe brackets 336 may include bracket support ribs 346, 347 (see also FIGS. 12-14) that increase the rigidity of the probe brackets 336. As illustrated in FIGS. 11-14, the rear probe brackets 336 proximate the rear edge 314 of the service lid 74 include triangular support ribs 346 on a back side of the rear probe brackets 336. As illustrated in FIGS. 12-14, the probe brackets 336 proximate the front edge 312 of the service lid 74 include front bracket support ribs 347 formed along the front surface of the forward probe brackets 336.

The probes 332 extend in a forward longitudinal direction LO from a probe bracket 336. The probes 332 each are formed by a plurality of prongs 333 which are arranged in a circular pattern such that there are gaps between each of the prongs 333. A radially outer surface 342 (FIG. 11) of each prong 333 is curved to generally match the curvature of the radially inner surface of the recesses 334 so that the probes 332 have a generally circular outer perimeter that is broken between the prongs 333. A diameter of the probes 332 (i.e., the diameter of the generally circular outer perimeter) may be dimensioned so that the probes 332 fit snugly in the recesses 334 to create an interference fit. For example, the illustrated probes 332 are configured so that the prongs 333 flex slightly inward upon insertion into the recesses 334. The flexibility of the prongs 333 helps to account for tolerance stack-up so that the probes 332 easily fit within the recesses 334. The prongs 333 may be formed from a resiliently deformable material, such as a polymeric material, an elastomeric material, and/or any other resiliently deformable material, so that the prongs 333 return to an unflexed state after removal of the probe 332 from the recess 334.

Referring to FIG. 11, the probes 332 and recesses 334 of the engagement devices 330 are positioned on the service lid 74 and service tray 32, respectively, such that each probe 332 is aligned with a corresponding one of the recesses 334. Each recess bracket 338 includes a locating surface 340 that is positioned behind the corresponding recess. The locating surfaces 340 are configured to support the service lid 74 via the probes 332 prior to insertion of the probes 332 into the recesses 334, and to guide the probes 332 towards the corresponding recess 334. For example, the laterally outer sides of the locating surfaces 340 of the recess brackets 338 positioned proximate the front of the marine drive 10 include sloped edges 344 that are configured to center the service lid 74 on the supporting frame 12 so that the probes 332 are aligned with the recesses 334. Additionally or alternatively, abutment between the lateral edge portions 316 of the service lid 74 and the deflector lips 318 on the port and starboard side panels 112, 114 may guide the service lid 74 towards the centered position on the service tray 32.

While in the service position (FIGS. 11 and 12), the service lid 74 can be removed from the marine drive 10 to provide access to the service compartment 76 and its contents. For example, the lifting eye 302, the spare engine lanyard clip 325, and other components in the service compartment 76, such as a fuse 304 (FIG. 6) are accessible. The illustrated service lid 74 may be removed and completely separated from the cowl body 72 when in the service position. Some embodiments, however, may include a service lid that is movably secured to a portion of the supporting frame 12 and/or the cowling 70. For example, a marine drive 10 may include a service lid 74 that is pivotably coupled to the marine drive 10, and/or a service lid 74 that is flexibly secured to the marine drive by a tether, such as a wire, cable, strap and/or any other type of flexible connector.

Referring to FIGS. 12-14, the service lid 74 can be secured to the marine drive 10 by moving the service lid 74 from the service position (FIG. 12) to the unregistered position (FIG. 13) by placing the service lid 74 on the service tray 32. As the service lid 74 is lowered onto the service tray 32, abutment between the probes 332 and the locating surfaces 340 and/or abutment between the lateral edge portions 316 of the service lid 74 and the deflector lips 318 on the port and starboard side panels 112, 114 center the service lid 74 on the marine drive 10. Once in the unregistered position, the service lid 74 can be moved into the registered position (FIG. 14) by sliding the service lid 74 along the supporting frame 12 and/or a portion of the cowl body 72 in a forward longitudinal direction LO towards the front of the marine drive 10. As the service lid 74 slides forward, engagement between the probes 332 and the locating surfaces 340 of the engagement devices 330 align service lid 74 relative to the cowl body 72 and guide the probes 332 into the corresponding recess 334. As the probes enter the recesses 334, the radially outer surfaces 342 of the prongs 333 abut the radially inner surface of the recesses 334, thereby causing the prongs 333 to flex radially inward towards the center of the probe 332. Contact between the prongs 333 and the recesses 334 creates a friction force that resists removal of the probes 332 from the recesses 334. Additionally, the tight fit between the probes 332 and the recesses 334 creates a semi-rigid connection between the service lid 74 and the service tray 32, which may be useful in order to prevent the service lid 74 from rattling while on the marine drive 10 thereby reducing and/or eliminating noise produced by vibrations of the service lid 74 on the supporting frame 12.

The service lid 74 can continue sliding forward until the bracket support ribs 347 on the forward probe brackets 336 abut an abutment surface 337 of the probe bracket 336 surrounding the recesses 334. While the service lid 74 is in the registered position, the front edge 312 of the service lid 74 is positioned below and overlapped by a lip 348 formed on the top edge 132 of the upper front panel 118 and the rear edge 314 of the service lid 74 is positioned above and overlaps a lip 349 formed along the top edge 134 of the rear panel 116, thereby limiting the ingress of water into the cowl interior 71.

In the embodiments of FIGS. 11-14, the engagement devices 330 each include a probe 332 on the service lid 74 and a recess 334 configured to receive the probe 332 on the supporting frame 12. However, some embodiments may be differently configured. For example, referring to FIGS. 21-25, embodiments of a service lid 74 and supporting frame 12 may include at least one engagement device 430 with a probe 432 positioned on the supporting frame 12 and a recess 434 configured to receive the probe 432 located on the bottom surface 320 of the service lid 74. Similarly to the embodiments of FIGS. 11-14, the service lid 74 of FIGS. 21-25 includes a body 310 that extends from a front edge 312 to a rear edge 314 and laterally between opposite port and starboard lateral edge portions 316. The service lid 74 is positionable on the service tray 32 and can be removed from the supporting frame 12 in order to provide access to the service compartment 76. The illustrated service lid 74 is movable into and between a service position (FIGS. 21 and 23) in which the service lid 74 is removed from the cowl body 72 and the service compartment 76, an unregistered position (FIG. 24) in which the service lid 74 at least partially covers the service compartment 76, and a registered position (FIG. 25) in which the service lid 74 encloses the service compartment 76 and may be locked relative to the cowl body 72.

Figure 21:
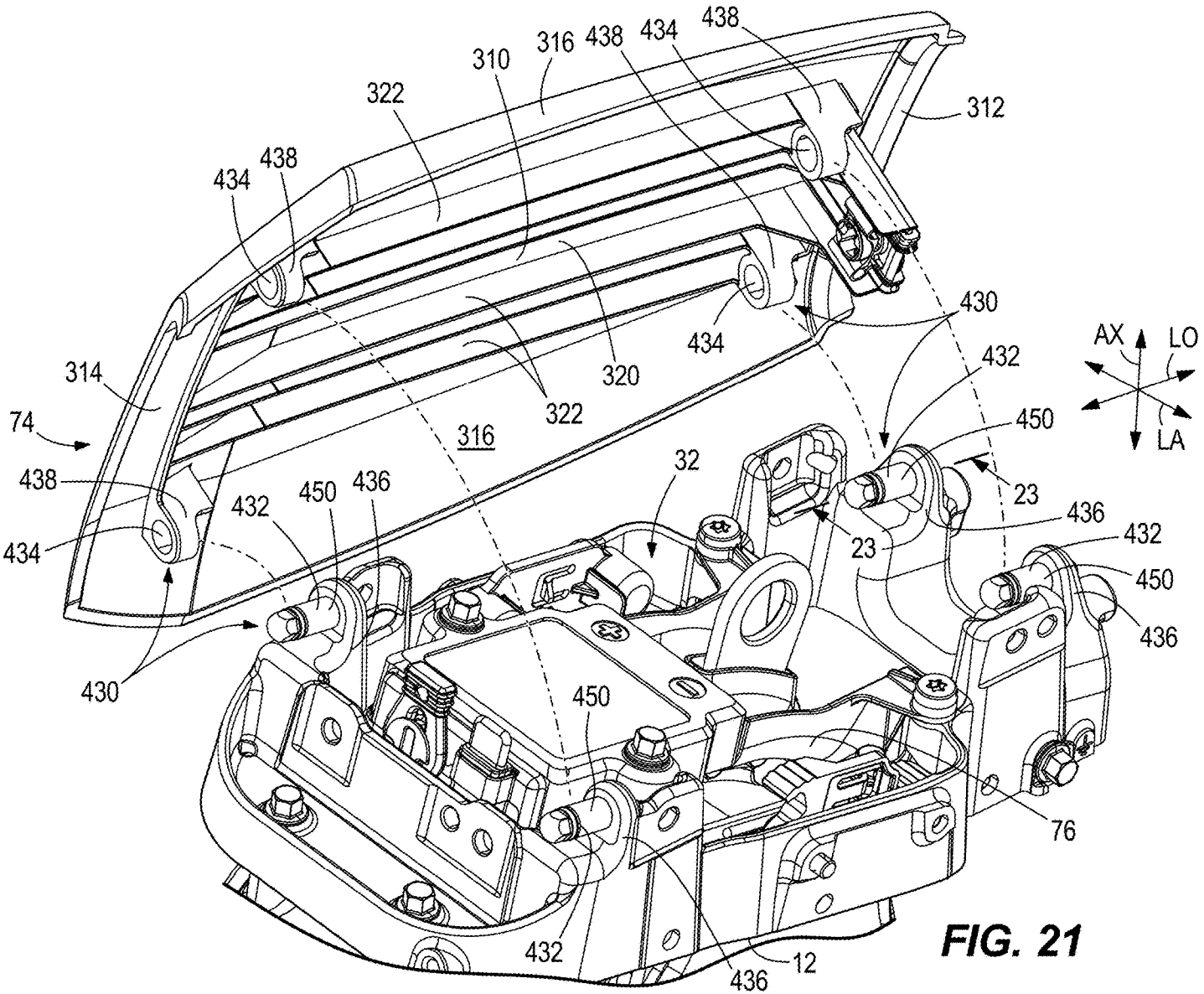
FIG. 21 is a perspective view of another embodiment of a service lid for a marine drive with a service compartment.
Figure 22:
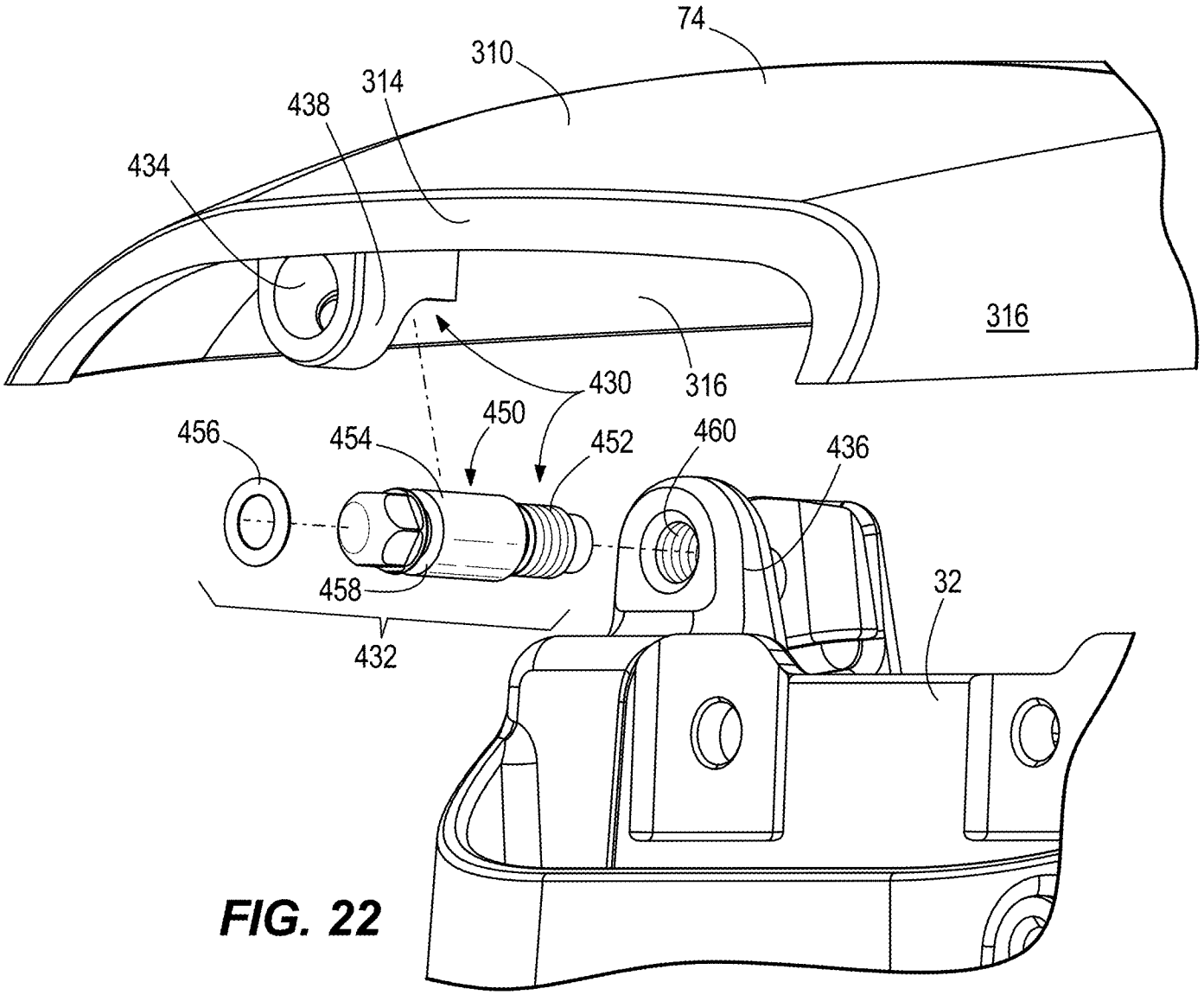
FIG. 22. is a detailed perspective view of an engagement device of the service lid and service compartment of FIG. 21.

Referring to FIGS. 21 and 22, the service lid 74 and the service tray 32 together include engagement devices 430 which facilitate engagement, sliding and registration of the service lid 74 relative to the supporting frame 12. The service lid 74 and service tray 32 include four engagement devices 430 that each have a probe 432 positioned in a probe bracket 436 on the supporting frame 12 and a recess 434 formed in a recess bracket 438 on a bottom surface 320 of the service lid 74. The probes 432 and recesses 434 of the engagement devices 430 are positioned on the service tray 32 and the service lid 74, respectively, such that each probe 432 is aligned with a corresponding one of the recesses 434.

With continued reference to FIGS. 21 and 22, the recesses 434 are configured as longitudinally extending through-bores that extend through recess brackets 438, which extend downwardly from the bottom surface 320 of the service lid 74. Each recess bracket 438 includes a locating surface 440 (FIG. 23) that is positioned in front of the corresponding recess 434. The locating surfaces 440 are configured to support the service lid 74 on the probes 432 prior to insertion of the probes 432 into the recesses 434, and to guide the probes 432 towards the corresponding recess 434.

Figure 25:
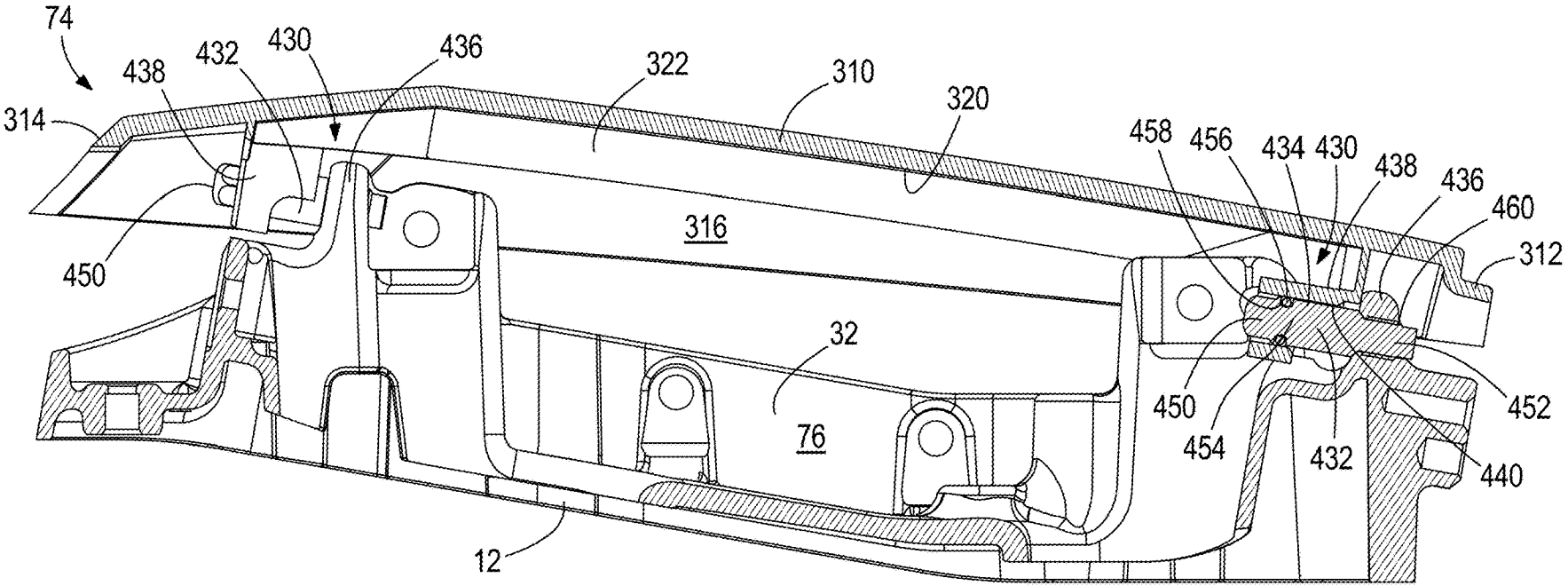
FIG. 25 is a view of section 23-23, taken in FIG. 21, with the service lid in the registered position.

Each probe 432 is connected to the supporting frame 12 by a probe bracket 436, which extends upwardly from the service tray 32. The probes 432 extend in a rearward longitudinal direction LO from the probe brackets 436. Referring to FIGS. 21 and 22, the probes 432 are configured as pins 450 with a first end 452 configured to be received in the probe bracket 436 and a second end configured to be received by a recess 434 in one of the recess brackets 438. The first end 452 of each pin 450 is threadedly engaged with an opening 460 formed in a probe bracket 436 to secure the pins 450 thereto. The second end 454 of each pin 450 is generally cylindrical and is configured to be slidably received into a corresponding one of the recesses 434. A seal member 456 (e.g., an elastomeric O-ring) is positioned in a circumferential groove 458 formed around the second end 454 of each pin 450. As illustrated in FIG. 25, when the probes 432 are received in the recesses 434, the seal member 456 on each pin 450 is sandwiched between the radially outer surface of the pin 450 and the radially inner surface of the recesses 434. Thus, the service lid 74 is supported on the probe 432 via the seal member 456. The recesses 434, the pins 450, and/or the seal members 456 may be dimensioned such that an interference fit is formed between the probes 432 and the recesses 434. This may be useful, for example, in order to retain the service lid 74 on the service tray 32. The tight fit between the probes 432 and the recesses 434 sandwiched the seal members 456 between the 432 and the recesses 434, thereby creating a resilient, semi-rigid connection between the service lid 74 and the service tray 32. This may be useful in order to prevent the service lid 74 from rattling while on the marine drive 10, thereby reducing and/or eliminating noise produced by vibrations of the service lid 74 on the supporting frame 12.

While in the service position (FIG. 23), the service lid 74 can be removed from the marine drive 10 to provide access to the service compartment 76 and its contents. The illustrated service lid 74 may be removed and completely separated from the cowl body 72 when in the service position. Some embodiments, however, may include a service lid that is movably secured to a portion of the supporting frame 12 and/or the cowling 70. For example, a marine drive 10 may include a service lid 74 that is pivotably coupled to the marine drive 10, and/or a service lid 74 that is flexibly secured to the marine drive by a tether, such as a wire, cable, strap and/or any other type of flexible connector.

Figure 23:
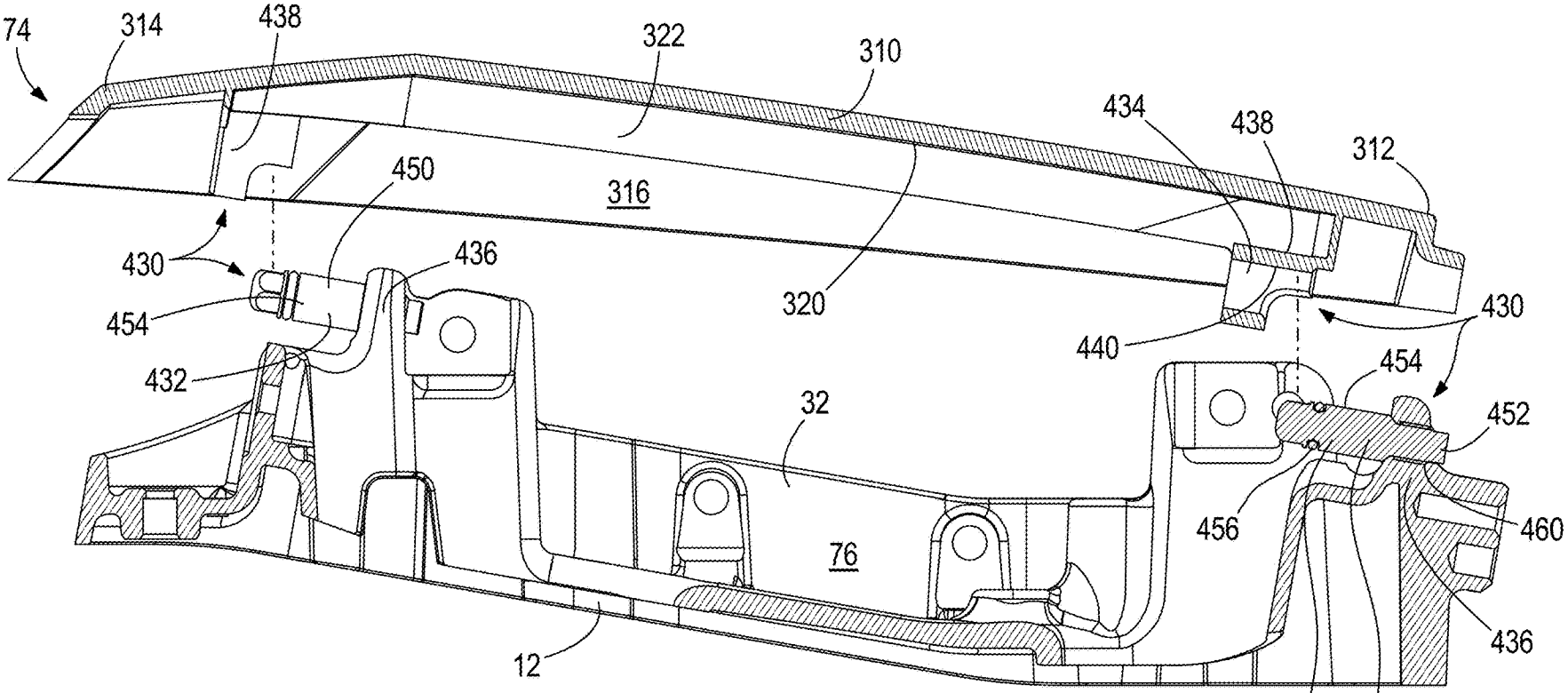
FIG. 23 is a view of section 23-23, taken in FIG. 21, with the service lid in the service position.
Figure 24:
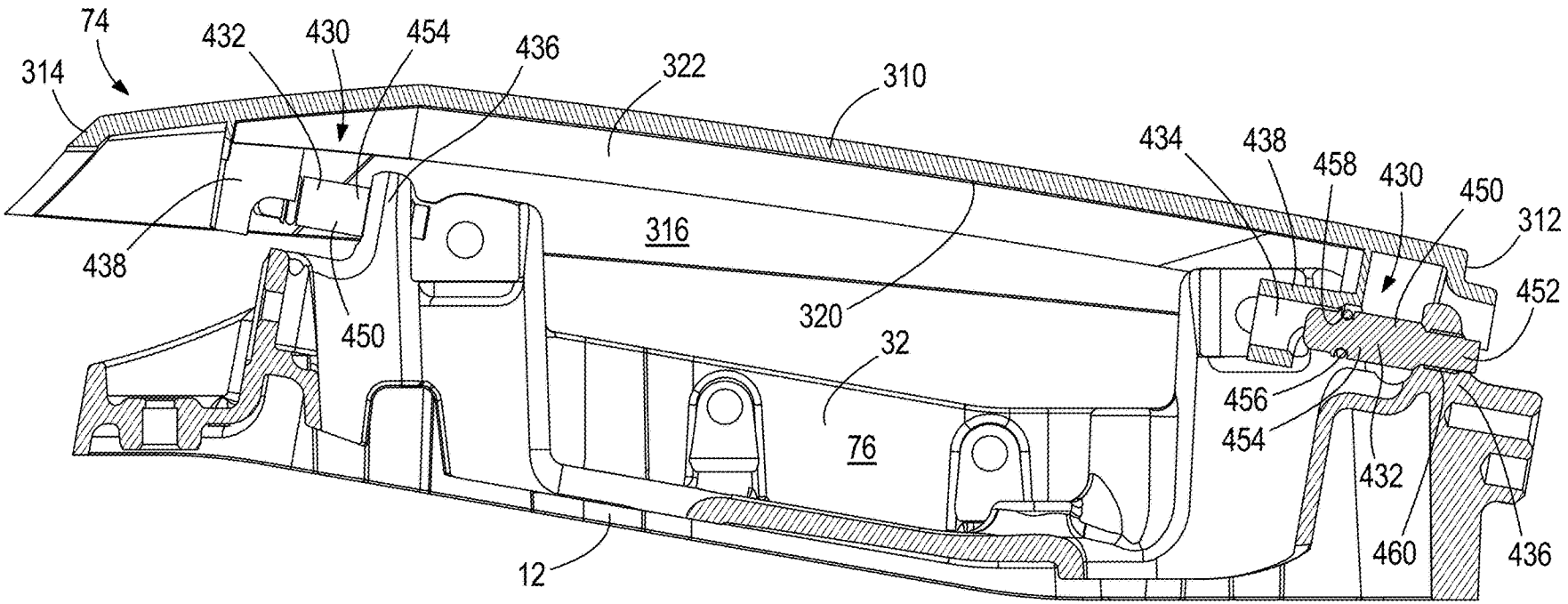
FIG. 24 is a view of section 23-23, taken in FIG. 21, with the service lid in the unregistered position.

Referring to FIGS. 23-25, the service lid 74 can be secured to the marine drive 10 by moving the service lid 74 from the service position (FIG. 23) to the unregistered position (FIG. 24) by placing the service lid 74 on the service tray 32. As the service lid 74 is lowered onto the service tray 32, abutment between the probes 432 and the locating surfaces 440 on the service lid 74 centers the service lid 74 on the marine drive 10. Once in the unregistered position, the service lid 74 can be moved into the registered position (FIG. 24) by sliding the service lid 74 along the supporting frame 12 and/or a portion of the cowl body 72 in a forward longitudinal direction LO towards the front of the marine drive 10. As the service lid 74 slides forward, engagement between the probes 432 and the locating surfaces 440 of the engagement devices 430 align service lid 74 relative to the cowl body 72 and guide the probes 432 into the corresponding recess 434.

As the probes 432 enter the recesses 434, the seal members 456 and/or the radially outer surfaces of the pins 450 abut the radially inner surface of the recesses 434. Engagement between the probes 432 and the recesses 434 creates a friction force that resists removal of the probes 432 from the recesses 434. Additionally, the tight fit between the probes 432 and the recesses 434 creates a semi-rigid connection between the service lid 74 and the service tray 32. All vibrations emanating from the marine drive 10 to the service lid 74 must travel through the seal members 456. In some embodiments, the seal members 456 may be configured as vibration dampening seal members 456. This may be useful in order to prevent the service lid 74 from rattling while on the marine drive 10 thereby reducing and/or eliminating noise produced by vibrations of the service lid 74 on the supporting frame 12.

Figure 15:
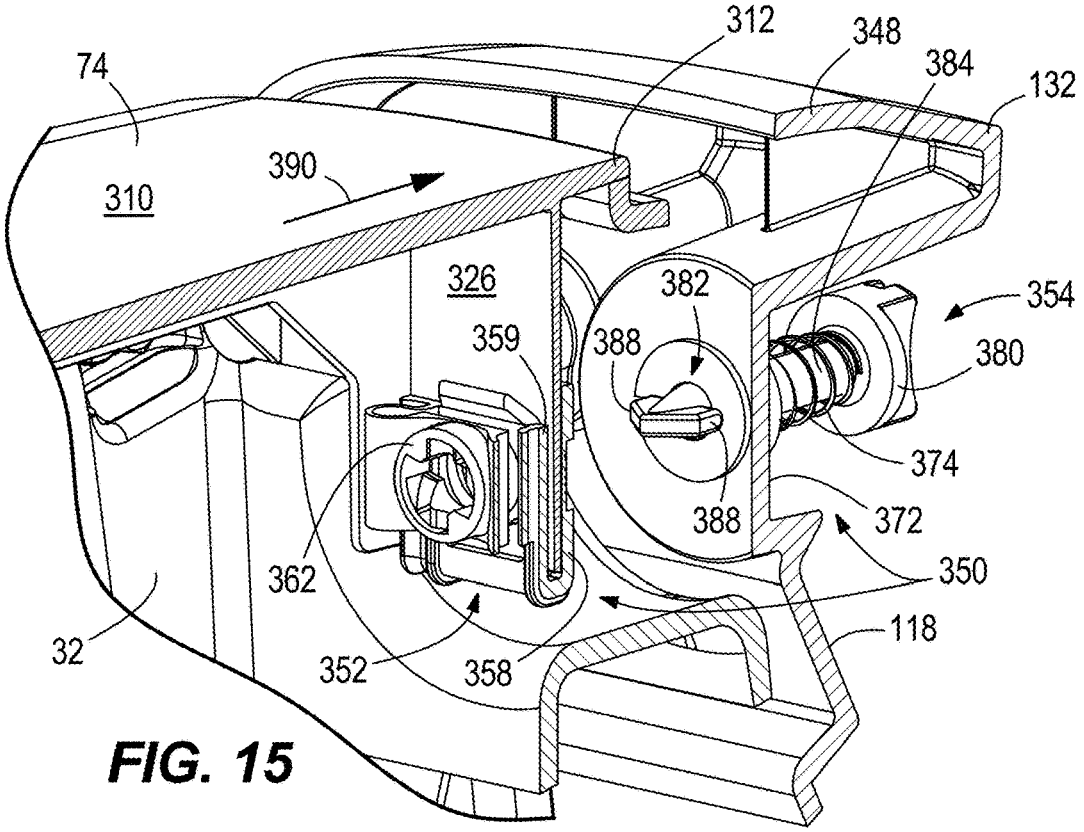
FIG. 15 is a view of section 15-15, taken in FIG. 11, with the service lid in the unregistered position.

Some embodiments of a marine drive may include a locking mechanism configured to retain the service lid 74 in the registered position. For example, referring to FIGS. 15-20, the marine drive 10 includes a toolless locking device 350 (FIGS. 15-17) operable to lock and unlock the service lid 74 in the registered position. The illustrated toolless locking device 350 is configured as a spring-loaded turnkey mechanism that includes a retainer clip 352 and a rotating latch member 354. Referring to FIGS. 15 and 20, the latch member 354 is symmetrical and includes a knob 380, a latch head 382, and a shaft 384 extending between the knob 380 and the latch head 382. The latch head 382 includes opposing latch bits 388 that extend radially outward from the shaft 384. The knob 380 is configured to be grasped and rotated by a user's fingers without any tools. However, the knob 380 may additionally or alternatively includes a slot 386 that may be engaged by a flat toolhead (e.g., a screwdriver) or another flat object to rotate the latch member 354.

Figure 17:
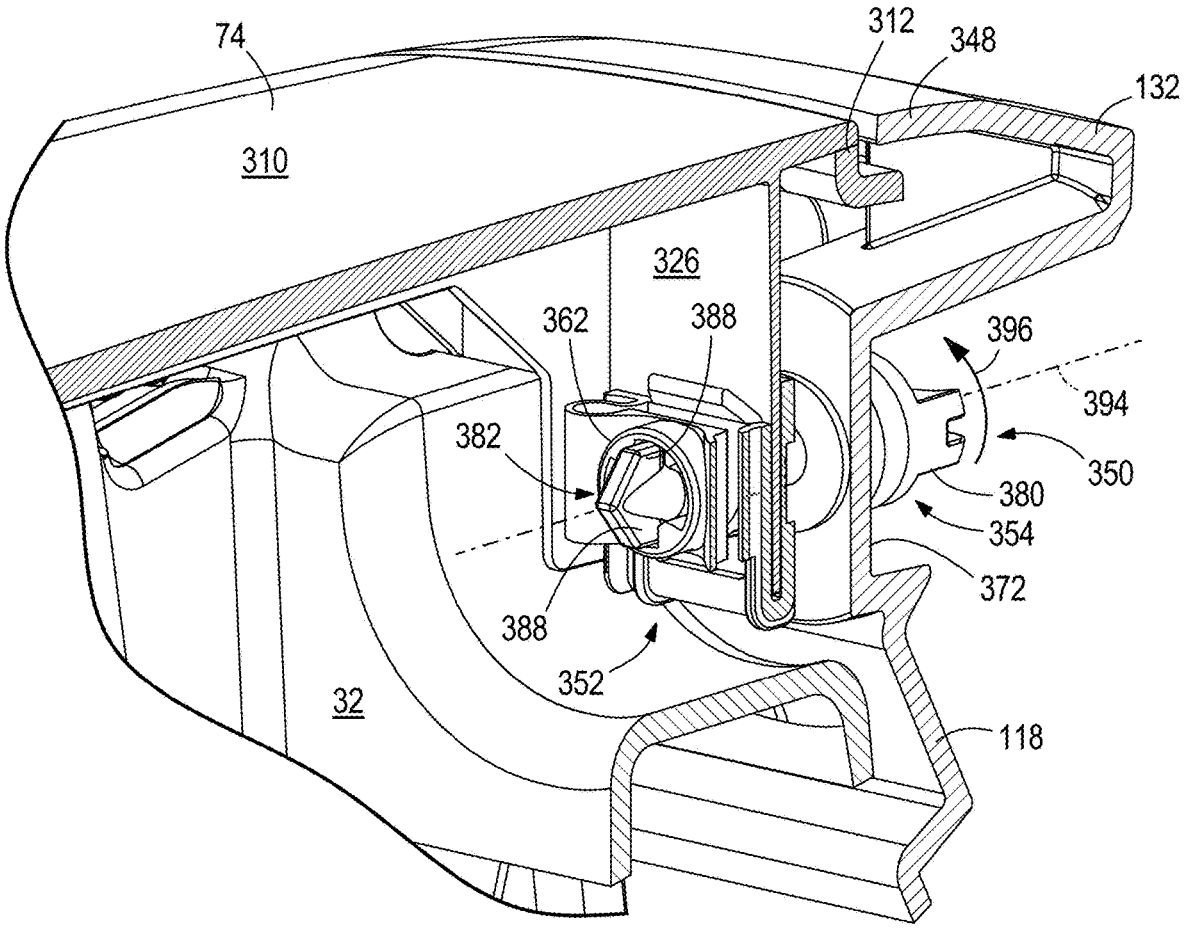
FIG. 17 is the detail view of section 15-15, taken in FIG. 11, with the service lid in the registered position and the locking device in the locked position.
Figure 18:
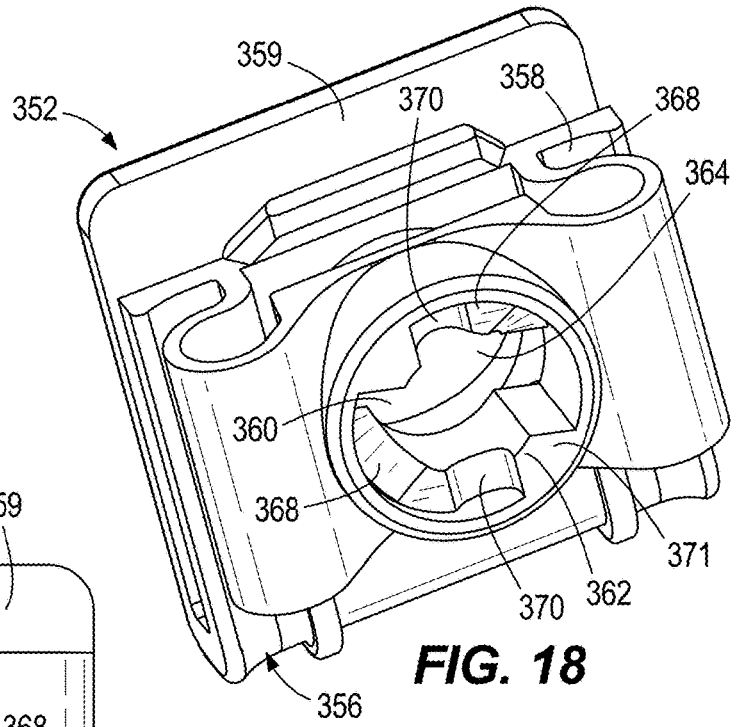
FIG. 18 is a perspective view of the receiver clip of the locking device of FIG. 17.
Figure 19:
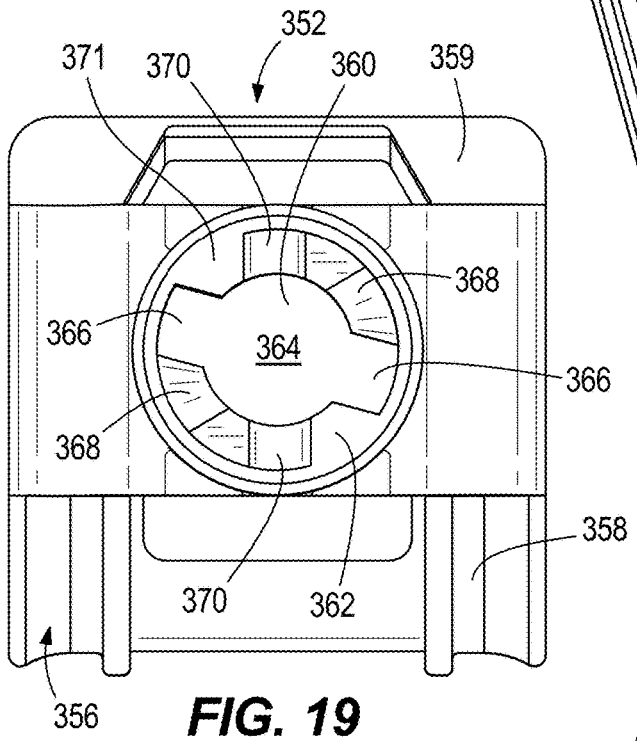
FIG. 19 is a front view of the receiver clip of the locking device of FIG. 18.
Figure 20:
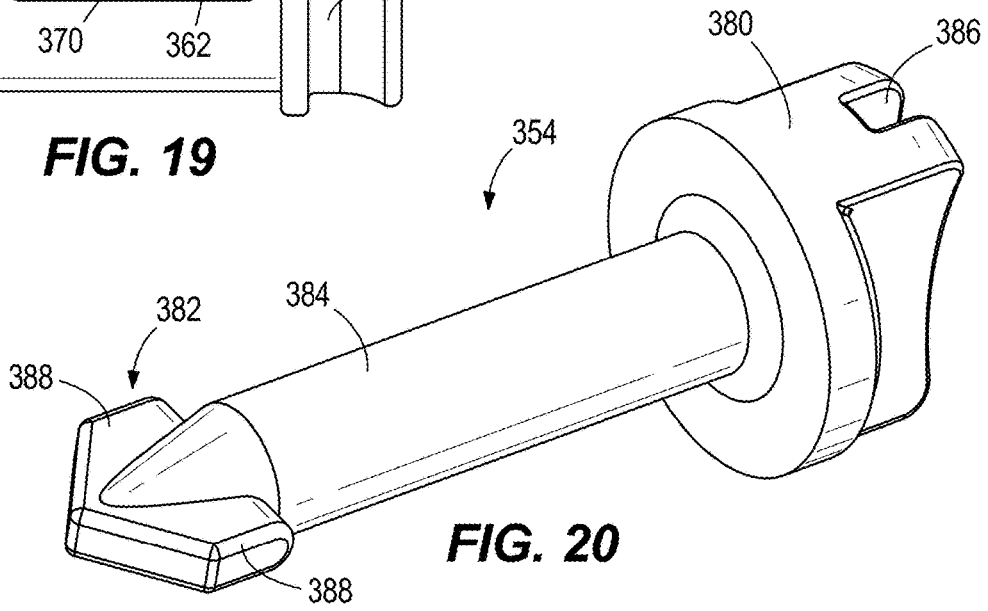
FIG. 20 is a perspective view of the latch member of the locking device of FIG. 17.

Referring FIGS. 18 and 19, the receiver clip 352 has a generally U-shaped body 356 with opposing interior and exterior clamping walls 358, 359 with concentric apertures 360 formed through the clamping walls 358, 359. A keyway 362 is positioned on the interior clamping wall 358 is configured to allow the latch member 354 to pass through the keyway 362 when the latch member 354 is in an unlocked position (FIGS. 15 and 16), and to prevent the latch member 354 from passing through the keyway 362 when the latch member 354 is in a locked position (FIG. 17). The keyway 362 includes a central through-bore 364 dimensioned to receive the shaft 384 of the latch member 354 and slots 366 extending radially outward from opposite sides of the central through-bore 364. The opposing slots 366 are formed through the body of the keyway 362 and are configured to allow the latch head 382 to pass through the keyway 362. Ramp surface 368 slope upwards from the slots and curve around the central through-bore 364 towards opposing recesses 370 extending radially outward from opposite sides of the central through-bore 364. The opposing recesses 370 are formed into an interior face 371 in the keyway 362 and are rotationally offset from the slots 386.

Figure 16:
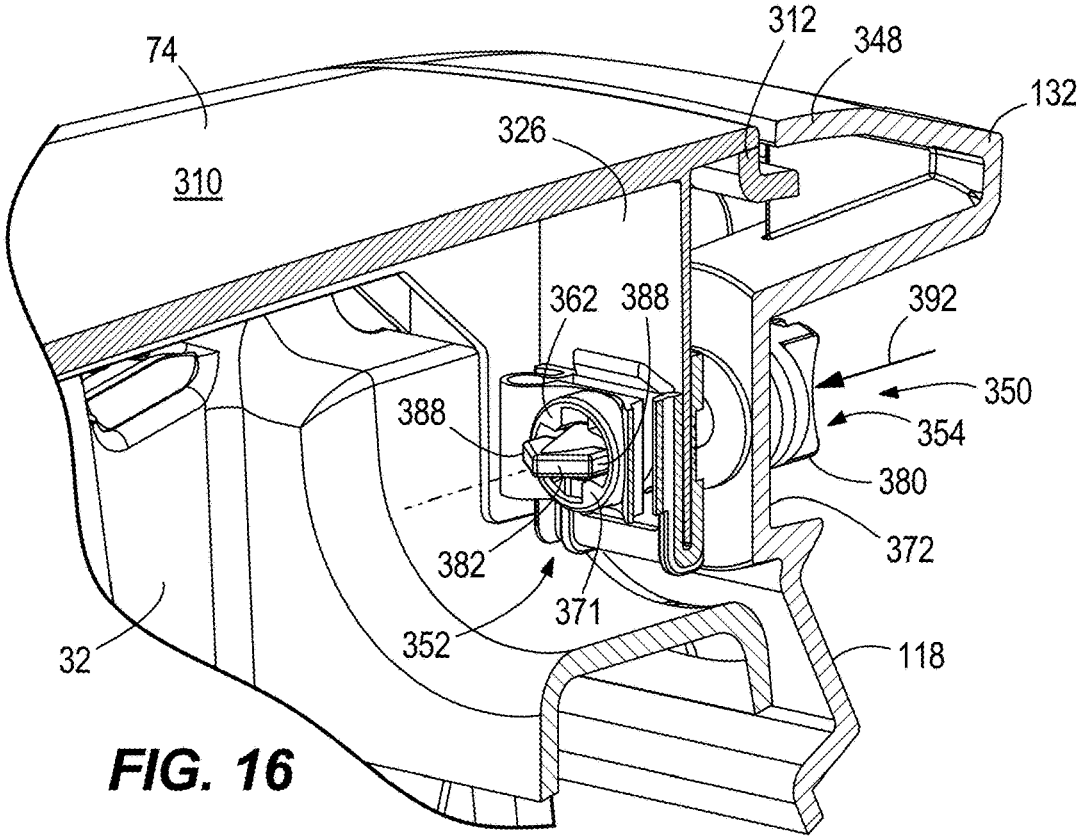
FIG. 16 is the detail view of section 15-15, taken in FIG. 11, with the service lid in the registered position and the locking device in the unlocked position.

Referring to FIGS. 15-17, the latch member 354 of the toolless locking device 350 is extends through an opening formed in a front surface 372 of the upper front panel 118. A spring 374 (FIG. 15) is positioned between the knob 380 and an exterior face of the front surface 372. The spring is configured to bias the latch member 354 outward into disengaged position (FIG. 15). The retainer clip 352 is secured to the generally planar lock bracket 326 with the clamping walls 358, 359 clamping onto opposing sides of the lock bracket 326. The retainer clip 352 is positioned on the lock bracket 326 such that the apertures 360 and the keyway 362 are aligned with an opening formed through the lock bracket 326.

To lock the service lid 74 in the registered position, thereby sealing and locking the service compartment 76, the service lid 74 is first moved from the unregistered position into the registered position by sliding the service lid 74 in the forward direction of arrow 390 along the service tray 32, as illustrated in FIG. 15. In some embodiments, the distal end of the latch head 382 on the latch member 354 may begin to enter into the apertures 360 formed in the retainer clip 352 as the service lid 74 approaches the registered position. Once the service lid 74 is in the registered position, the latch member 354 may be fully inserted through the keyway 362 of the retainer clip 352 by pressing the knob 380 in the backwards direction of arrow 392, thereby moving the latch member 354 into unlocked position illustrated in FIG. 16.

After being fully inserted, the latch member 354 can be rotated about the locking axis 394, which extends through the center of the latch member 354 and the keyway, into the locked position, as illustrated in FIG. 17. As the latch member 354 rotates, the latch bits 388 slide along the ramp surfaces 368 (FIGS. 18 and 19). Abutment between the latch bits 388 and the ramp surfaces 368 presses the retainer clip 352 forward towards the upper front panel 118, thereby pushing the service lid 74 forward if service lid 74 was not fully in the registered position. When the latch member 354 is fully rotated into the locked position, the latch bits 388 of the latch head 382 slide into the opposing recesses 370 formed in the keyway 362. The spring 374 continues to bias the latch member 354 in the forward direction, thereby retaining the latch bits 388 into the opposing recesses 370. Engagement between the latch bits 388 and the opposing recesses 370 resists rotation of the latch member 354 back towards the unlocked position, thereby securing the service lid 74 in position of the marine drive 10.

In the illustrated embodiments, the latch member 354 is concentric with the locking axis 394 such that the mass of the latch member 354 is symmetrically distributed about the locking axis 394. Thus, the latch member 354 is evenly balanced such that its center of gravity is located along the locking axis 394 so that forces resulting from bumps and/or impacts to the marine drive 10 do not cause the latch member 354 to rotate about the locking axis 394 in any direction.

In the illustrated embodiments, the latch member 354 is moved into the locked position by rotating the knob 380 in the direction of arrow 396, which is counterclockwise direction when facing the front side of the marine drive 10. Some embodiments, however, may be configured so that the latch member 354 is moved into the locked position by rotating the knob 380 in the opposite direction.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A marine drive for propelling a marine vessel in water, the marine drive comprising:

an upper unit including a frame body and a service tray, a lower unit for supporting a propulsor for propelling the marine drive in the water, wherein the lower unit is suspended from the upper unit and is configured for attachment to the marine vessel via a mounting bracket which supports the marine drive relative to the marine vessel, a cowling suspended from the service tray apart from the lower unit, and a vibration isolating joint which couples the lower unit to the upper unit to vibrationally isolate the upper unit and the cowling from the lower unit and the marine vessel.

2. The marine drive according to claim 1, wherein vibrations emanating from the propulsor are transferred via the lower unit to the vibration isolating joint, thereby vibrationally isolating the upper unit and the cowling from the propulsor.

3. The marine drive according to claim 1, further comprising an electric motor on the lower unit, the electric motor being configured to power the propulsor, wherein vibrations from the electric motor are transferred via the lower unit to the vibration isolating joint, thereby vibrationally isolating the upper unit and the cowling from the electric motor.

4. The marine drive according to claim 3, wherein the lower unit further comprises a torpedo housing, wherein the electric motor is supported in the torpedo housing.

5. The marine drive according to claim 1, wherein the upper unit comprises a supporting frame and wherein the lower unit comprises an extension leg which extends from and is suspended on the supporting frame via the vibration isolating joint.

6. The marine drive according to claim 5, wherein the supporting frame comprises a lower mounting flange and wherein the extension leg comprises an upper mounting flange which faces the lower mounting flange, and wherein the vibration isolating joint couples the lower mounting flange to the upper mounting flange.

7. The marine drive according to claim 6, wherein the vibration isolating joint comprises an elastomeric member which is clamped between the lower mounting flange and the upper mounting flange and configured to limit transfer of vibrations from the extension leg to the supporting frame.

8. The marine drive according to claim 7, wherein the vibration isolating joint further comprises a compression limiter which prevents over clamping of the elastomeric member during assembly of the lower unit and the upper unit.

9. The marine drive according to claim 8, wherein the vibration isolating joint further comprises a fastener, and wherein tightening the fastener clamps the elastomeric member between the extension leg and the supporting frame, and wherein the compression limiter prevents over tightening of the fastener to thereby prevent over compression of the elastomeric member.

10. The marine drive according to claim 9, wherein tightening the fastener clamps the elastomeric member between the lower mounting flange and the upper mounting flange.

11. The marine drive according to claim 9, wherein the compression limiter comprises a first limiter portion located between the extension leg and the supporting frame and a second limiter portion located on an opposite side of one of the extension leg and the supporting frame relative to the first limiter portion, and wherein the elastomeric member comprises a first resilient portion located between the first limiter portion and the one of the extension leg and the supporting frame and a second resilient portion located between the second limiter portion and the one of the extension leg and the supporting frame, and wherein the fastener extends through the first limiter portion and the second limiter portion.

12. The marine drive according to claim 1, wherein the cowling has a first cowl portion and a second cowl portion which together define a cowl interior in which the upper unit is disposed, wherein the first cowl portion and the second cowl portion are separate components.

13. The marine drive according to claim 12, wherein each of the first cowl portion and the second cowl portion is coupled to the upper unit, and further wherein the first cowl portion and the second cowl portion are coupled to each other, apart from the upper unit.

14. The marine drive according to claim 13, wherein the first cowl portion is a port side cowl portion and wherein the second cowl portion is a starboard side cowl portion, and wherein the port side cowl portion and the starboard side cowl portion are fastened to opposite sides of the upper unit and separately to each other.

15. The marine drive according to claim 1, further comprising a service lid on the service tray.

16. A marine drive for propelling a marine vessel in water, the marine drive extending from a top to a bottom along a first axis, from a port side to a starboard side along a second axis which is perpendicular to the first axis, and from a front to a back along a third axis which is perpendicular to the first axis and perpendicular to the second axis, the marine drive comprising:

an upper unit including a service tray, a lower unit disposed below the upper unit along the first axis, the lower unit configured to support a propulsor for propelling the marine drive in the water, wherein the lower unit is suspended from the upper unit and is configured for attachment to the marine vessel via a mounting bracket which supports the marine drive relative to the marine vessel, a cowling suspended from the service tray apart from the lower unit, the cowling comprising an upper portion which is coupled to and encloses the upper unit and a lower portion which is spaced apart from but encloses an upper portion of the lower unit, and a vibration isolating joint which couples the lower unit to the upper unit to vibrationally isolate the upper unit and the cowling from the lower unit and the marine vessel.

17. The marine drive according to claim 16, wherein vibrations emanating from the propulsor are transferred to the marine vessel via the lower unit and to the vibration isolating joint, thereby vibrationally isolating the upper unit and the cowling from the propulsor and the marine vessel.

18. The marine drive according to claim 16, wherein the cowling further comprises a first cowl portion and a second cowl portion which are separate components and are both coupled to the upper unit, and further wherein the first cowl portion and the second cowl portion have lower portions that are coupled to each other and completely spaced apart from the upper unit, thereby further vibrationally isolating the upper unit and the cowling from the propulsor and the marine vessel.

19. The marine drive according to claim 16, wherein the cowling further comprises a port side cowl portion and a starboard side cowl portion that is a separate component from the port side cowl portion, and wherein the port side cowl portion and the starboard side cowl portion are fastened to the port side and the starboard side of the upper unit, respectively, and also fastened to each other.

* * * * *